United States Patent [19]

Denda

[11] Patent Number: 4,757,451

[45] Date of Patent: Jul. 12, 1988

[54] FILM FOLDING CONTROL APPARATUS OF WRAPPING SYSTEM

[75] Inventor: Toshio Denda, Tokyo, Japan

[73] Assignee: Teraoka Seiko Co., Limited, Tokyo, Japan

[21] Appl. No.: 868,509

[22] Filed: May 30, 1986

[30] Foreign Application Priority Data

May 31, 1985 [JP] Japan ..... 60-117907

[51] Int. Cl.[4] ..... B65B 57/10

[52] U.S. Cl. ..... 364/468; 364/475; 53/556; 53/502; 53/228

[58] Field of Search ..... 364/475, 468; 53/556, 53/502, 228

[56] References Cited

U.S. PATENT DOCUMENTS

| | | | |
|---|---|---|---|
| 4,141,442 | 2/1979 | Cole et al. | 53/502 X |
| 4,510,731 | 4/1985 | Mathieu | 53/556 X |
| 4,543,766 | 10/1985 | Boshinski | 53/556 X |
| 4,604,704 | 8/1986 | Eaves et al. | 364/468 X |
| 4,616,474 | 10/1986 | Morley et al. | 53/556 |
| 4,628,668 | 12/1986 | Wildmoser | 53/556 X |
| 4,658,570 | 4/1987 | Thomas | 53/556 |
| 4,674,269 | 6/1987 | Denda | 53/228 X |

*Primary Examiner*—Jerry Smith
*Assistant Examiner*—Steve Long Hoang
*Attorney, Agent, or Firm*—Armstrong, Nikaido, Marmelstein & Kubovcik

[57] ABSTRACT

A film folding control apparatus of a wrapping machine is a type in which a length of film fed by a film feeding mechanism is extended at a predetermined section of the wrapping machine. An article to be wrapped is raised into taut engagement with the extended film from therebelow. The edges of the film are folded under the bottom of the article, thereby wrapping the article in the film, by a film folding mechanism comprising left, right and front folding plates. The control apparatus comprises a data setting device for setting film length data, film tension data and tray type data in dependence upon a number of an article to be wrapped. A preset memory stores this data in correspondence with the number of the article to be wrapped. A control unit is responsive to an input of the number of the article to be wrapped. The control unit reads the corresponding film length data, film tension data and tray type data out of the preset memory and controls, on the basis of the read data, the operating timing of such operating sections of the wrapping machine as the left, right and front folding plates and grippers for grasping both edges of the film.

19 Claims, 17 Drawing Sheets

Fig.14(A) Fig.14(B) Fig.14(C) Fig.14(D)

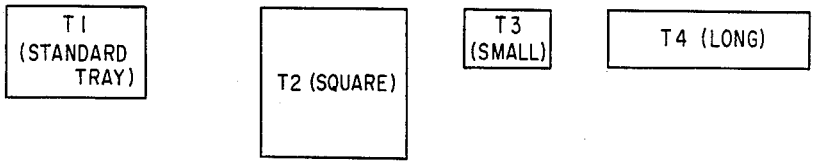

Fig. 15

| SW1 / SW3 | 1 | 2 | 3 | 4 |
|---|---|---|---|---|
| T1 | A | B | C | D |
| T2 | C | C | C | D |
| T3 | A | A | B | B |
| T4 | C | C | D | D |

A ~ D : CUT FILM LENGTH CATEGORIES
SW1 : FILM LENGTH SELECTION SWITCH
SW3 : TRAY TYPE CHANGEOVER SWITCH

Fig. 17

| Fℓ | A | B | C | D |
|---|---|---|---|---|
| Tm | 6 (30°) | 8 (40°) | 8 (40°) | 8 (40°) |

Fℓ : CUT FILM LENGTH
Tm : OPERATION TIMING OF LEFT AND RIGHT FOLDING PLATES

Fig. 16

| SW3 | T1 (STANDARD TRAY) | | | | | T2 (SQUARE) | | | | | T3 (SMALL) | | | | | T4 (LONG) | | | | |
|---|---|---|---|---|---|---|---|---|---|---|---|---|---|---|---|---|---|---|---|---|
| SW2 / SW1 | 1 | 2 | 3 | 4 | 5 | 1 | 2 | 3 | 4 | 5 | 1 | 2 | 3 | 4 | 5 | 1 | 2 | 3 | 4 | 5 |
| 1 | – | – | a | – | – | – | – | a | – | – | – | – | d | – | – | – | – | a | – | – |
| 2 | – | – | b | – | – | – | – | a | – | – | – | – | d | – | – | – | – | a | – | – |
| 3 | – | – | c | – | – | – | – | b | – | – | – | – | d | – | – | – | – | a | – | – |
| 4 | – | – | d | – | – | – | – | b | – | – | – | – | e | – | – | – | – | b | – | – |

SW2 : FILM TENSION ADJUSTMENT SWITCH
a – e : LEFT-RIGHT FRONT GRIPPER RELEASE TIMINGS FOR FILM TENSION ADJUSTMENT

| WCP | SW1 | SW2 | SW3 |
|---|---|---|---|
| 00 | 3 | 3 | T1 |
| 01 | 3 | 4 | T1 |
| 02 | 3 | 2 | T1 |
| ⋮ | ⋮ | ⋮ | ⋮ |
| 15 | 4 | 2 | T2 |
| ⋮ | ⋮ | ⋮ | ⋮ |
| 35 | 1 | 2 | T4 |

| ARTICLE NUMBER | UNIT PRICE | TARE | | ARTICLE NAME | WCP |
|---|---|---|---|---|---|
| 0001 | | | | | |
| 0002 | 350 | 10 | | MEAT | 01 |
| ⋮ | ⋮ | | | | |
| 1204 | | | | | |

Fig. 23

| TEMPERATURE T | Cv |
|---|---|
| LOWER THAN 9°C | +1 |
| 10°C ~ 19°C | 0 |
| 20°C ~ 29°C | -1 |
| HIGHER THAN 30°C | -2 |

FILM FOLDING CONTROL APPARATUS OF WRAPPING SYSTEM

BACKGROUND OF THE INVENTION

This invention relates to a film folding control apparatus of a wrapping system in which articles accommodated in individual trays are wrapped in a stretchable film on a tray-by-tray basis.

A variety of wrapping machines are known in the art for introducing articles into tray-shaped containers (hereafter referred to simply as trays) and wrapping each tray in a stretchable film. The applicant has already developed a wrapping machine in which a length of film fed by a film feeding mechanism is extended at a predetermined section of the wrapping machine, an article to be wrapped is raised into taut engagement with the extended film from therebelow, and the edges of the film are folded under the bottom of the article, thereby wrapping the article in the film, by means of a film folding mechanism comprising left, right and front folding plates. Inventions claiming various aspects of this wrapping machine have been filed with the Japanese Patent Office as Japanese Utility Model Application Nos. 59-133273 and 59-133274, and Japanese Patent Application No 59-182466.

In the wrapping machine having the foregoing construction, the final appearance of the wrapped articles depends upon such factors as the size, material, shape and dimensions of the tray into which the articles are introduced. In order to improve the appearance of a packaged wrapped by the aforementioned wrapping machine, the applicant has also developed a film folding control apparatus, filed with the Japanese Patent Office as Japanese Patent Application No. 60-24686, in which the length to which the film is cut, the amount of tension applied to the film and the tray type can be set at a control panel through use of switches denoted by SW1, SW2, SW3 in the specification of the cited application.

With the above film folding control apparatus used in the wrapping machine of the type described, the fact that film cut length, tension and tray type can be set by the switches SW1, SW2, SW3 at the control panel enables the final appearance of the wrapped packages to be improved and makes it possible to reduce wasteful use of the film. However, in actually using the wrapping machine to wrap articles, the operator must make the above settings by manipulating each one of the switches SW1, SW2, SW3 whenever the type of article to be wrapped is changed. This is a troublesome task which detracts from the efficiency of the machine. Moreover, the particular values to which the film cutting length, tension and tray type are to be set depending upon the type of article to be wrapped must either be memorized by the operator himself or written in the form of a list affixed to a surface in the vicinity of the machine and referred to each time a setting is to be made. Both of these expedients are inconvenient.

SUMMARY OF THE INVENTION

Accordingly, an object of the present invention is to provide a film folding control apparatus of a wrapping machine in which the troublesome setting operation mentioned above is eliminated and an attractively wrapped package is obtained merely by the operator's inputting an article number, namely a preset data call number corresponding to an article to be wrapped.

According to the present invention, the foregoing object is attained by providing a film folding control apparatus of a wrapping machine of the type in which a length of film fed by a film feeding mechanism is extended at a predetermined section of the wrapping machine. An article to be wrapped is raised into taut engagement with the extended film from therebelow. The edges of the film are folded under the bottom of the article, thereby wrapping the article in the film, by a film folding mechanism comprising left, right and front folding plates. The control apparatus comprises a data setting device for setting film length data, film tension data and tray type data in dependence upon a number of an article to be wrapped. A preset memory stores the film length data, film tension data and tray type data in correspondence with the number of the article to be wrapped. A control unit, responsive to an input of the number of the article to be wrapped reads the corresponding film length data, film tension data and tray type data out of the preset memory and controls, on the basis of the read data, the operating timing of such operating sections of the wrapping machine as the folding mechanism comprising the left, right and front folding plates and grippers for grasping both edges of the film.

According to another feature of the present invention, the wrapping machine is used in combination with a weighing and pricing machine and the arrangement is such that the operating sections of the wrapping machine are controlled upon entry of various data such as an article number from a control unit of the weighing and pricing machine.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIGS. 3 through 5 are views illustrating the structure of a wrapping machine, in which FIG. 3 is a plan view, FIG. 4 is a longitudinal sectional front view (as seen from the direction of the arrow A in FIG. 3), and FIG. 5 is a longitudinal sectional side view (as seen from the direction of the arrow B in FIG. 3);

FIGS. 6 and 7 are views illustrating the structure of a film feeding mechanism included in the wrapping machine, in which FIG. 6 is a plan view and FIG. 7 is a side view;

FIGS. 14(A), (B), (C) and (D) are views depicting the shapes of various trays;

FIG. 15 is a view showing the relationship between a film length selection switch SW1 and a tray type changeover switch SW3;

FIG. 16 is a view showing the relationship among a film length setting switch SW1, a film tension setting switch SW2, and a tray type changeover switch SW3;

FIG. 17 is a view showing the relationship between cut length of film and the operating timing of left and right folding plates;

FIG. 23 is a view illustrating timing correction values corresponding to various temperatures.

DESCRIPTION OF THE PREFERRED EMBODIMENT

Let us begin by describing a wrapping system in which the folding control apparatus of the present invention is employed.

Figure 2:
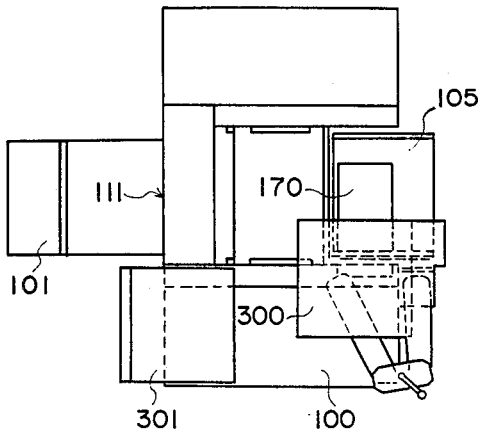
FIG. 2 illustrates the external appearance of the wrapping system, in which (A) is a plan view, (B) a front view and (C) a side view.
Figure 2:
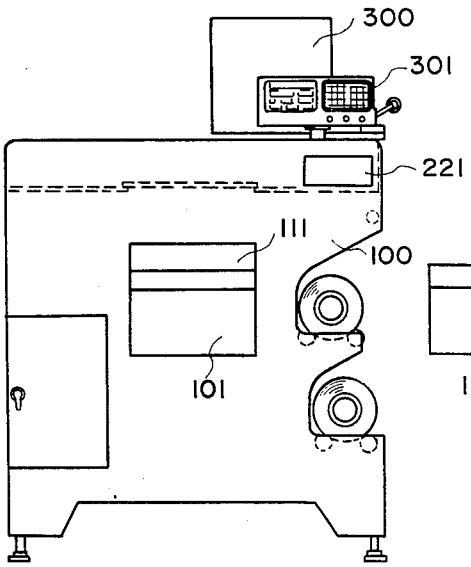
Figure 2:
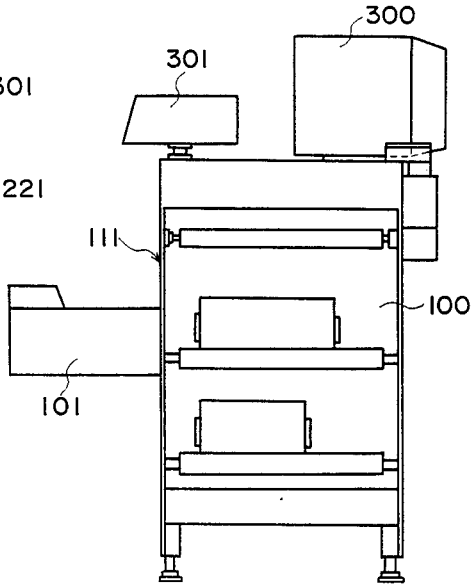

FIG. 2 illustrates the external appearance of a wrapping machine in accordance with the invention, in which (A) is a plan view, (B) a front view and (C) a side view. As illustrated, a wrapping system comprises a wrapping machine 100 and a weighing and pricing machine 300. The wrapping machine 100 has an infeed conveyance mechanism 101 for feeding in articles, which are to be wrapped, via an infeed opening 111. The articles so introduced into the wrapping machine are wrapped by a film folding mechanism, described below, after which the wrapped articles are fed out of the wrapping machine 100 by an outfeed conveyance mechanism 105. Each wrapped article so discharged from the wrapping machine 100 is positioned by a lateral slider 170 at label affixing location of a labeler constituting the weighing and pricing machine 300. Here a label on which is printed such information as the name, weight and price of the article is affixed to the wrapped article. The weight of an article to be wrapped is measured by a weigher provided on the infeed conveyance mechanism 101 of the wrapping machine 100. It is also permissible to weigh a wrapped article by a weigher provided on the outfeed conveyance mechanism 105. The weighing and pricing machine 300 has a console 301.

Figure 3:
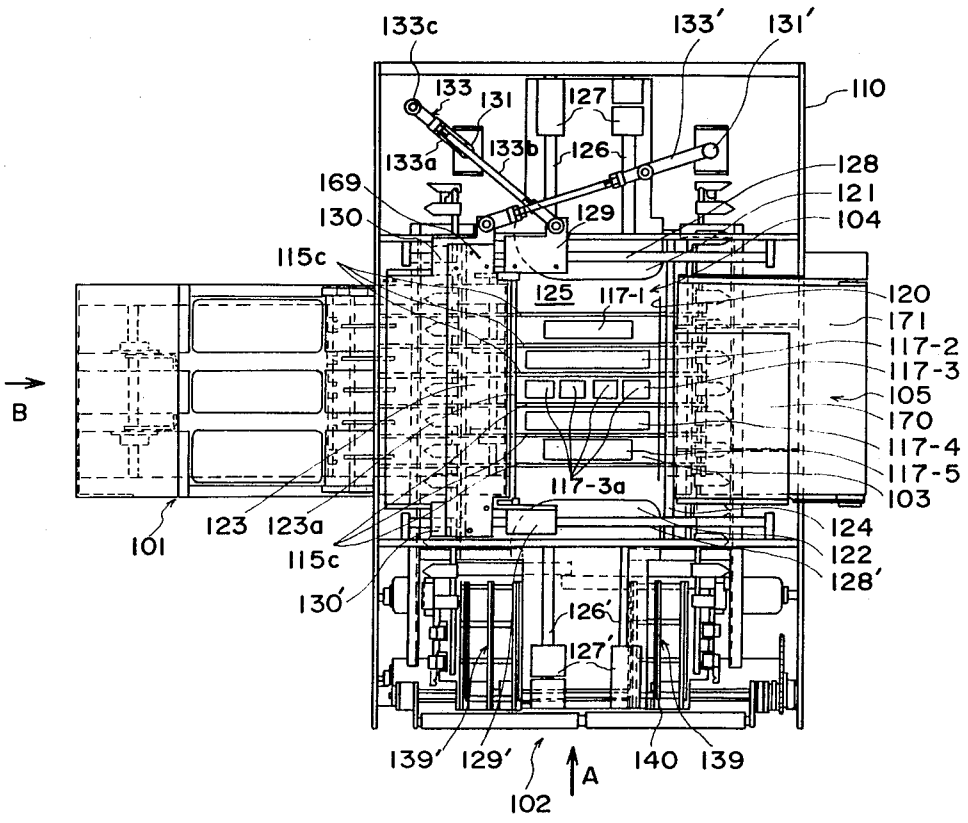
Figure 4:
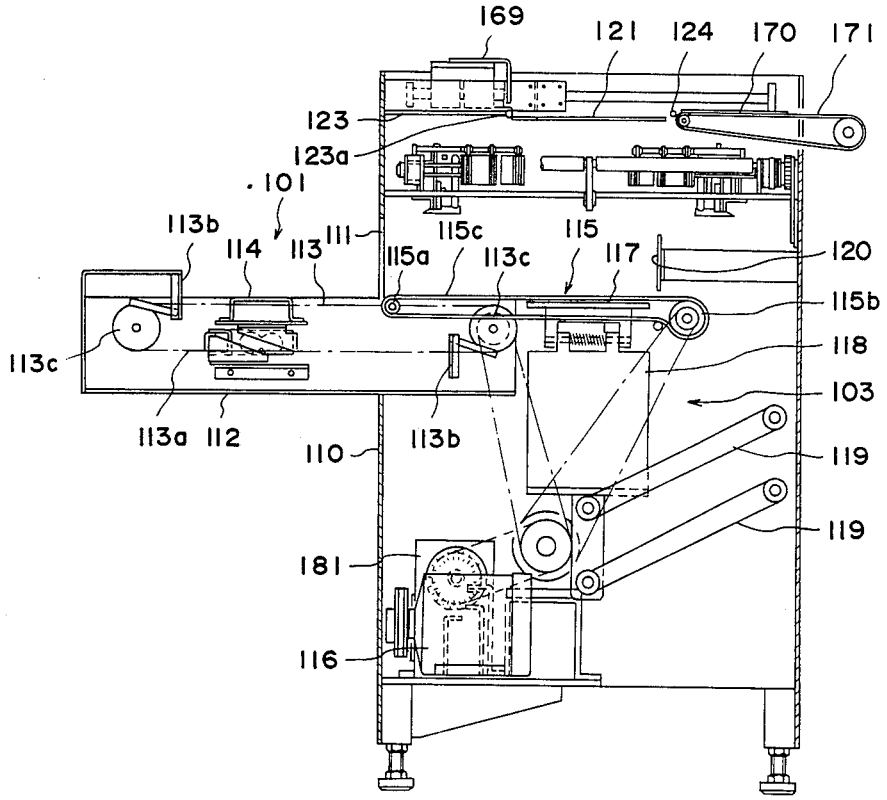
Figure 5:
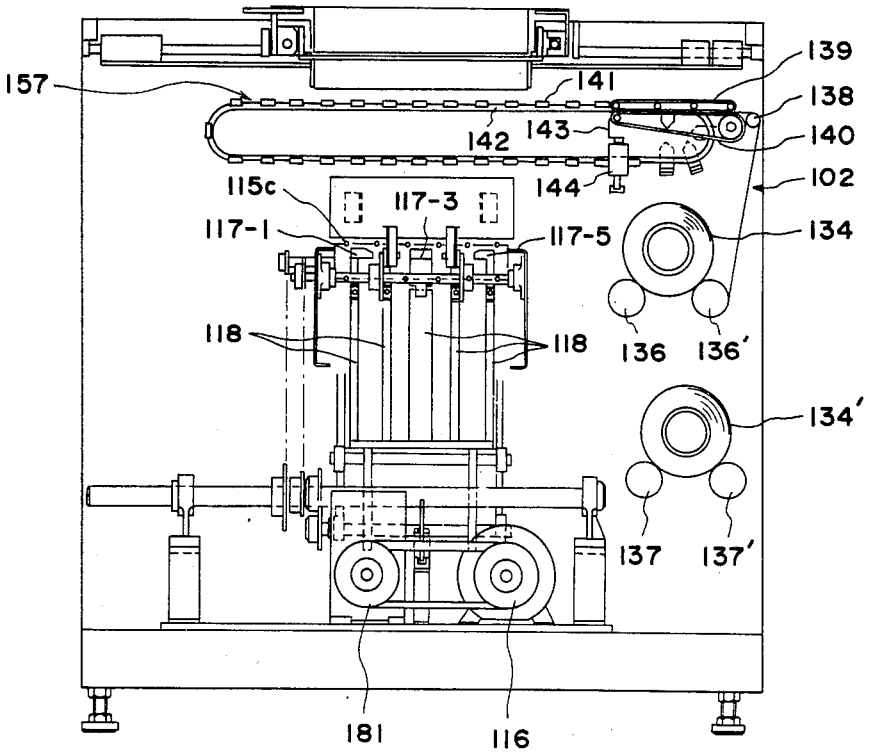

FIG. 3 is a plan view illustrating the overall structure of the wrapping machine 100, FIG. 4 is a longitudinal sectional front view (as seen from the direction of the arrow A in FIG. 3), and FIG. 5 is a longitudinal sectional side view (as seen from the direction of the arrow B in FIG. 3).

The wrapping machine 100 comprises the infeed conveyance mechanism 101 for feeding in articles to be wrapped. A film feeding mechanism 102 unreels and feeds a stretchable film. An elevator mechanism 103 raises an article to be wrapped, which has been fed in by the infeed conveyance mechanism 100, into stretching engagement with a length of the stretchable film delivered by the film feeding mechanism 102. A folding mechanism 104 (see FIG. 9) folds the opposing left and right edges as well as the front and rear edges of a cut length of the stretchable film, which covers the article to be wrapped, under the tray carrying the article. The outfeed conveyance mechanism 105 feeds out the article which has been wrapped by having the stretchable film folded thereunder by the folding mechanism 104.

The foregoing mechanisms will now be described in detail. For the sake of the description, the left and right sides of FIG. 3 shall be referred to as the front side and rear sides of the wrapping machine, respectively, and the upper and lower sides of FIG. 1 shall be referred to as the left and right sides of the wrapping machine, respectively. Therefore, the left, right, front and rear edges of a cut length of stretchable film mentioned hereinbelow will correspond to the left, right, front and rear sides of the wrapping machine as defined above.

The wrapping machine has a machine frame 110 the front side of which is provided with a generally centrally located infeed opening 111 having an infeed frame 112 in which a pusher conveyor 113 is arranged. The pusher conveyor 113 includes a pair of endless chains **113*a* provided with two pushers 113*b* at predetermined locations, and two sprockets 113*c*, 113*c* engaging with the respective endless chains 113*a*, 113*a* for driving the pusher conveyor 113. The arrangement is such that a single article to be wrapped is fed every half revolution of the endless chains. A weigher 114 is provided on the infeed side of the pusher conveyor 113 for measuring the weight of the article fed in by the conveyor. Arranged downstream of the pusher conveyor 113 is a belt conveyor 115 for carrying the article fed in by the pusher conveyor 113 to an elevator bed 117 of the elevator mechanism 103. The belt conveyor 115 comprises freely rotatable rollers 115*a*, 115*b* and six round rubber belts 115*c* stretched between the rollers 115*a*, 115*b*. The pusher conveyor 113 and belt conveyor 115 construct the infeed conveyance mechanism 101**.

The elevator mechanism 103 comprises the elevator bed 117, a mount 118 for attaching the elevator bed 117, and a pair of arms 119, 119 supporting the mount 118. The elevator mechanism is to be moved up and down at a predetermined timing via a reduction gear mechanism 181 in response to rotation of a motor 116. The timing for the vertical motion performed by elevator mechanism 103 is set by the shape of a cam in a cam mechanism, described below, which acts in a mechanism for transmitting power from the motor 116 to the mount 118.

The elevator bed 117 raises the article to be wrapped, which has been fed in by the pusher conveyor 113 and belt conveyor 115, up to the position at which folding is performed by the folding mechanism 104. To accomplish this, the position occupied by the vertically travelling elevator bed 117, when the bed is at the lowermost end of is stroke, is set at a position substantially level with the conveying surface of the belt conveyor 115. The position occupied by the elevator bed 117 at the uppermost end of its stroke is set to lie substantially in the same plane as left, right and front folding plates 121, 122, 123, respectively, which are described below and which constitute the aforementioned folding mechanism 104.

As shown in FIGS. 3 and 5, the elevator bed 117 is composed of blade-shaped slats 117-1 through 117-5, and the mount 118 is composed of individual slats separated from one another to correspond to the slats 117-1 through 117-5 of the elevator bed. Thus, the arrangement is such that the elevator bed 117 and mount 118 will not strike the rubber belts 115*c* of belt conveyor 115 when the elevator bed 117 is moved up and down. The central slat 117-3 of the elevator bed 117 is split into a plurality of small slats 117-3*a* each of which is urged into an upstanding attitude at all times by biasing means, not shown, but which are forcibly reclined to the right in FIG. 3 by a force applied from the left in the same Figure. The slats 117-1, 117-2 located on the upper side of the central slat 117-3*a*, as seen in FIG. 3, are forcibly reclined downwardly in FIG. 3 by a force applied from above in the same Figure. The slats 117-4, 117-5 located on the lower side of the central slat 17-3, as seen in FIG. 3, are forcibly reclined upwardly in FIG. 1 by a force applied from below in the same Figure. This arrangement allows the folding operation performed by the folding mechanism 104 to proceed without impedement, as will be set forth below.

As shown in FIGS. 3 and 5, a positioning plate 120 is provided in back of the elevator bed 117 and serves to position an article to be wrapped, which has been conveyed into place by the belt conveyor 115, at a rear-edge reference.

As shown in FIG. 5, the film feed mechanism 102 is to unreel a continuous web of stretchable film from stretchable film supply rolls 134, 134' provided on the right side of the wrapping machine 100 and to feed the film by gripping it at the longitudinal side edges thereof. The stretchable film supply rolls 134, 134', on which there are wound continuous webs of stretchable films of different width, are supported by pairs of support rollers 136, 136' and 137, 137', respectively, with the supply roll 134 or 134' being selected for use depending upon the size of the article to be wrapped. The upper stretchable film supply roll 134 is shown to be in use in the example of FIG. 5.

The continuous web of stretchable film unreeled from the stretchable film supply roll 134 is drawn out so as to wrap around the right support roller 136', and is embraced at its longitudinally extending side edges between upper delivery belts 139, 139' and lower delivery belts 140, 140' through the intermediary of a roller 138 for sensing the end of the film. The stretchable film embraced by the upper and lower delivery belts 139, 139'; 140, 140' is delivered up to the forward ends of these belts by the circulation thereof. The stretchable film is subsequently embraced at its longitudinally extending edge portions between grippers 141, 141' of respective chain conveyors 157, 157', described below, and round rubber belts 142, 142', each comprising a rubber material, so that a predetermined length of the film necessary for wrapping the article may be delivered thereby. When the predetermined length of the stretchable film has thus been delivered, a cutter 143 is raised by a cutter drive unit 144 to sever the film from the continuous web thereof. The cut length of stretchable film is thereafter fed to a predetermined position overlying the elevator head 117, namely until the center of the cut length of film coincides with the center of the elevator head 117. The feed of the cut length of film is then halted.

The left and right folding plates 121, 122, the front folding plate 123 and a rear folding roller 124 define an opening 125. As shown in FIGS. 3 and 5, the gripper groups 141, 141' and the rubber belts 142, 142' are arranged to lie between the opening 125 and the lower end of the stroke of the elevator head 117 and, when the wrapping machine is viewed from above, to oppose each other and flank the opening 125 from the front and rear.

In the present specification, the article outfeed side of the folding mechanism shall be referred to as the rear side, and the side opposite this shall be referred to as the front side. These terms are used without relation to the infeed direction of the articles to be wrapped.

Figure 6:
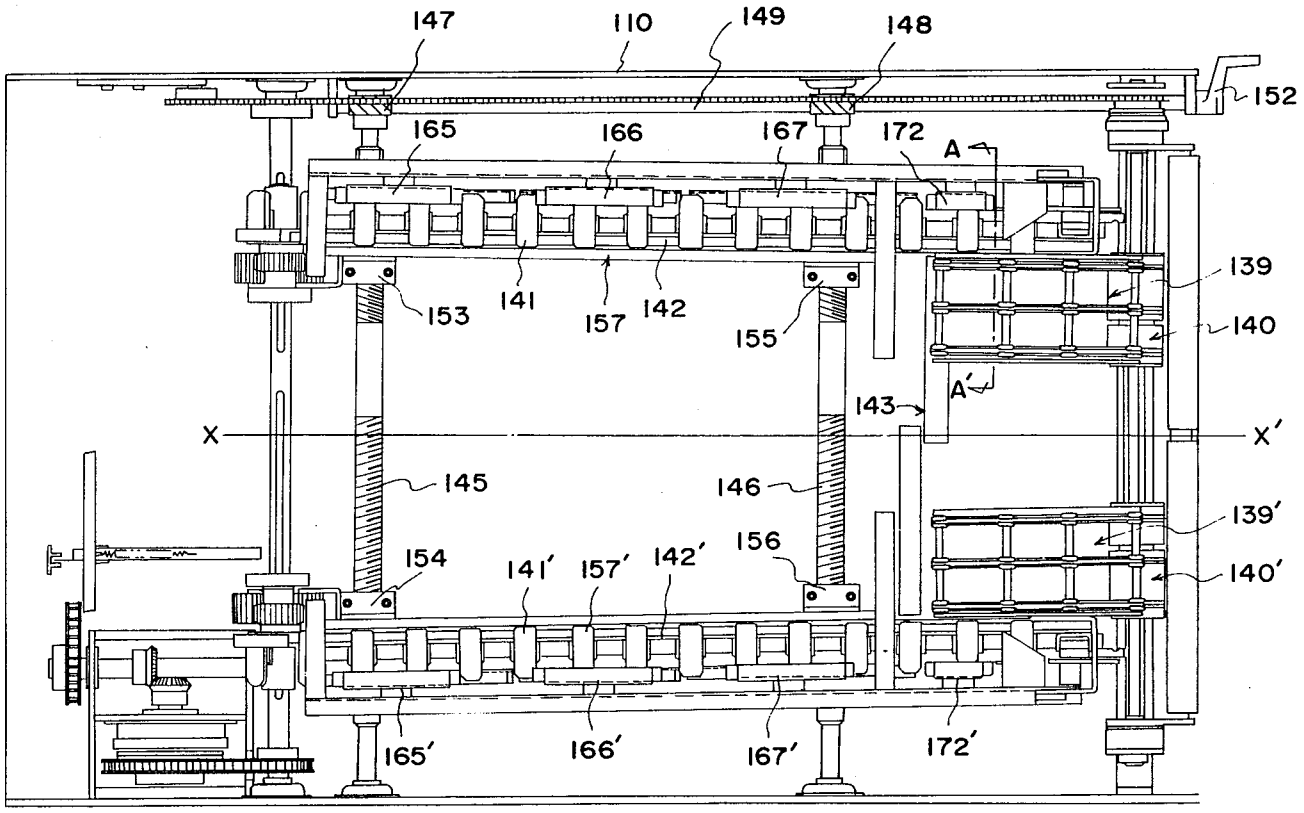
Figure 7:
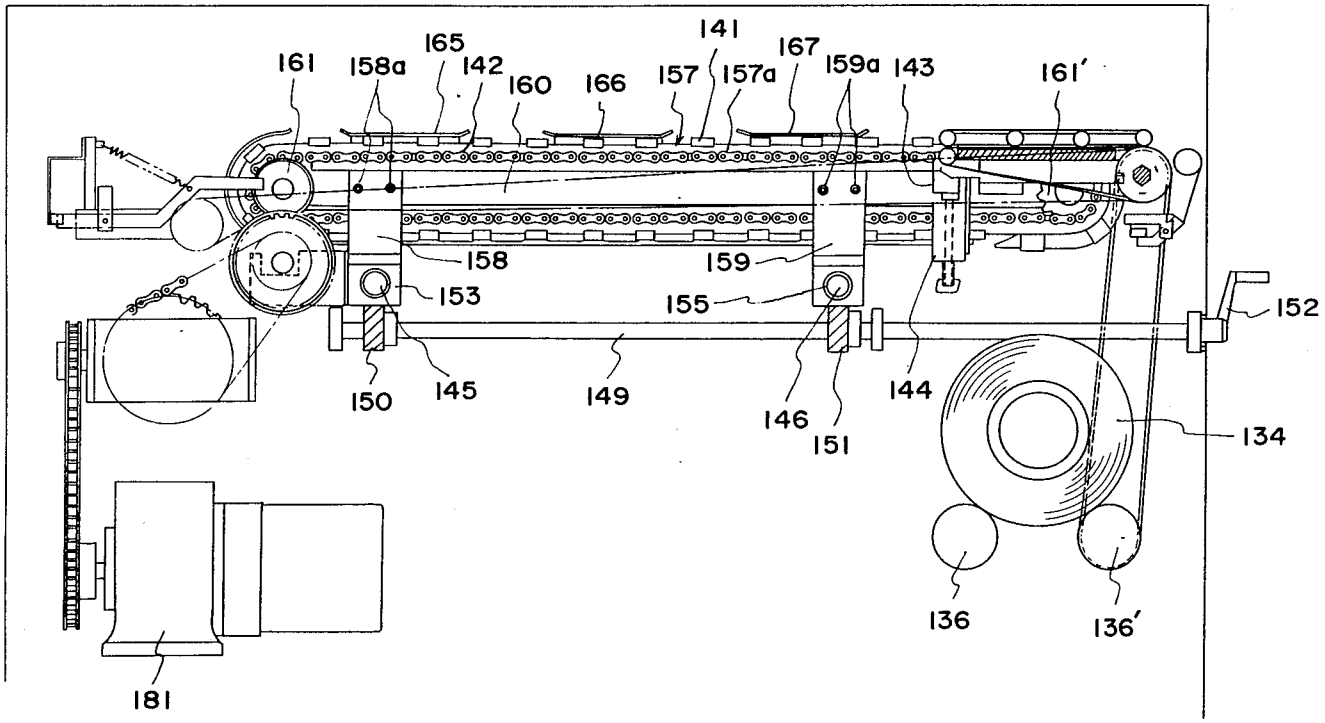

Reference will now be had to FIGS. 6 and 7 to describe the film feeding mechanism 102 in still greater detail. A pair of adjust screws 145, 146 are rotatably provided in opposing relation at prescribed positions of the machine frame 110 and have respective hypoid gears 147, 148 secured thereto at their rear end portions. Arranged along the rear face of the machine frame 110 is a rotary shaft 149 to which are secured at prescribed positions a pair of hypoid gears 150, 151 meshing with the respective hypoid gears 147, 148. A handle 152 is attached to right-hand end portion of the rotary shaft 149 outboard of the machine frame 110. The adjust screws 145, 146 can be rotated through the rotary shaft 149 by turning the handle 152.

The adjust screws 145, 146, which are reversely threaded with respect to each other, have a close screw pitch on the upper side of FIG. 6 and a less dense screw pitch on the lower side of FIG. 6. Provided in close proximity to both ends of the adjust screws 145, 146 are adjust blocks 153 through 156 having nuts which engage with the threaded portions of respective ones of the adjust screws. The adjust blocks 153, 155 at the rear serve as a base for the chain conveyor 157, and the adjust blocks 154, 156 at the front serve as a base for the chain conveyor 157'.

The chain conveyors 157, 157' are arranged so as to diverge from each other in relation to a central axis X–X' in the direction of film feed, whereby the film is tensioned strongly in the width direction and extended in the same direction as it is fed.

The chain conveyors 157, 157' are symmetrical in structure and only the structure of chain conveyor 157 will be described. As shown in FIG. 7, the adjust block 153 is provided with a mounting and supporting member 158, and the adjust block 155 is provided with a mounting and supporting member 159. Fixedly attached to the mounting and supporting members 158, 159 by a plurality of respective screws 158*a*, 159*a* is a mounting base plate 160. Sprockets 161, 161' which rotate freely are disposed on the opposite ends of the mounting base plate 160, and an endless chain 157*a* is stretched between the sprockets 161, 161'.

Figure 8:
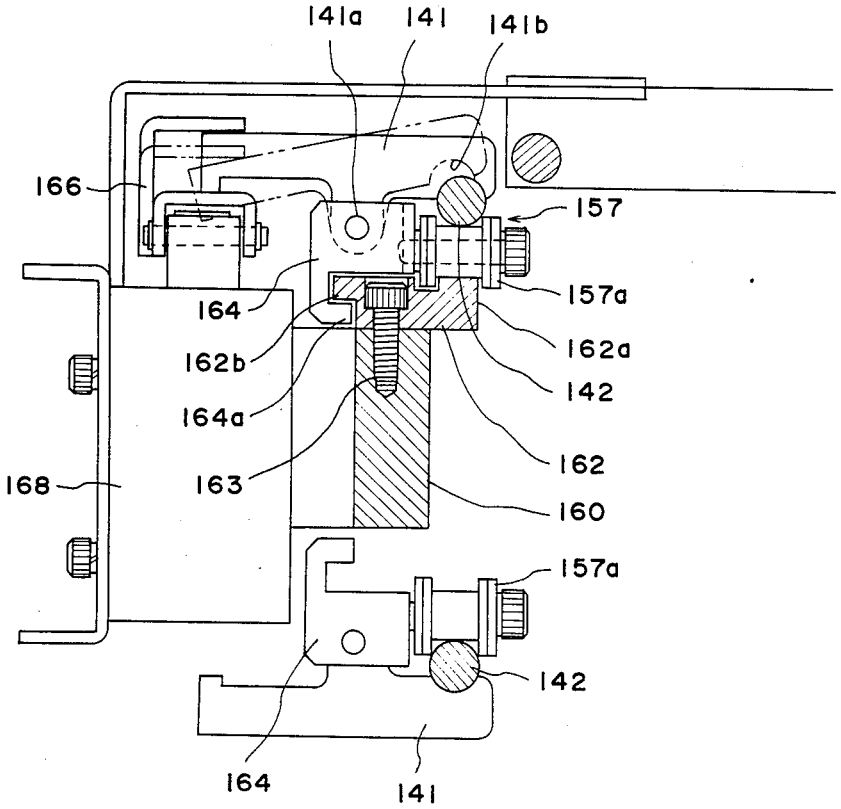
FIG. 8 is a sectional view showing a gripper portion mechanism of the wrapping machine.

As shown in FIG. 8, the round rubber belt 142, which is an endless belt having a circular cross section, is disposed to lie on the outer periphery of the chain 157*a*. A plurality of the grippers 141, which are spaced apart from one another by a prescribed distance, are mounted for pivotal motion externally of the chain 157*a* about respective shafts 141*a*. The distal end portion of each gripper 141 is formed to include a semicircular recess 141*b* shaped to fit over the round rubber belt 142. A support plate 162 is attached to the upper portion of the mounting base plate 160 by a screw 163 and extends over a prescribed region of the mounting plate. The support plate 162 is formed to include a projection 162*a* as an integral part thereof fitted into the central recess of the chain 157*a* for guiding the same, and a projection 162*b* as an integral part thereof which mates with an engagement flange 164*a* formed on a mounting plate 164 to which the gripper 141 is attached, thus guiding and supporting the mounting plate 164.

Left, central and right movable guide members 165, 166, 167 are provided at predetermined positions outboard of the chain conveyor 157 in close proximity thereto, and left, central and right movable guide members 165', 166', 167' are provided at predetermined positions outboard of the chain conveyor 157' in close proximity thereto. Further, the chain conveyors 157, 157' are provided with movable guide members 172, 172' outboard of the cutter 143.

The movable guide members 165–167, 165'–167' are of substantially the same structure. Each of these movable guide members 165–167, 165'–167' is engaged by the rear ends of three grippers 141. For example, when a solenoid 168 is energized, the grippers 141 are rotated simultaneously about their respective shafts 141*a*, whereby the recess 141*b* in the distal end of each gripper 141 separates from the round rubber belt 142, as shown by the phantom lines in FIG. 8. When the solenoid 168 is deenergized, the recesses 141*b* at the ends of the three respective grippers 141 are forced into contact with the round rubber belt 142 by springs, not shown. The stretchable film is embraced between and fed by the recesses 141*b* at the ends of the grippers 141 and the round rubber belt 142. The movable guide members 172, 172' are arranged to engage only one gripper each and have a structure which is substantially the same as that of the movable guide members 165–167, 165'–167'. Accordingly, a description of the movable guide members 172, 172' is deleted.

As shown in FIG. 3, the folding mechanism 104 comprises the left and right folding plates 121, 122, the front folding plate 123 and the rear folding roller 124, these elements forming the opening 125 through which an article to be wrapped raised by the elevator bed 117 is passed.

The left and right folding plates 121, 122 are flat plates for underfolding left and right edges of a cut length of stretchable film tautly covering the article to be wrapped.

Figure 9:
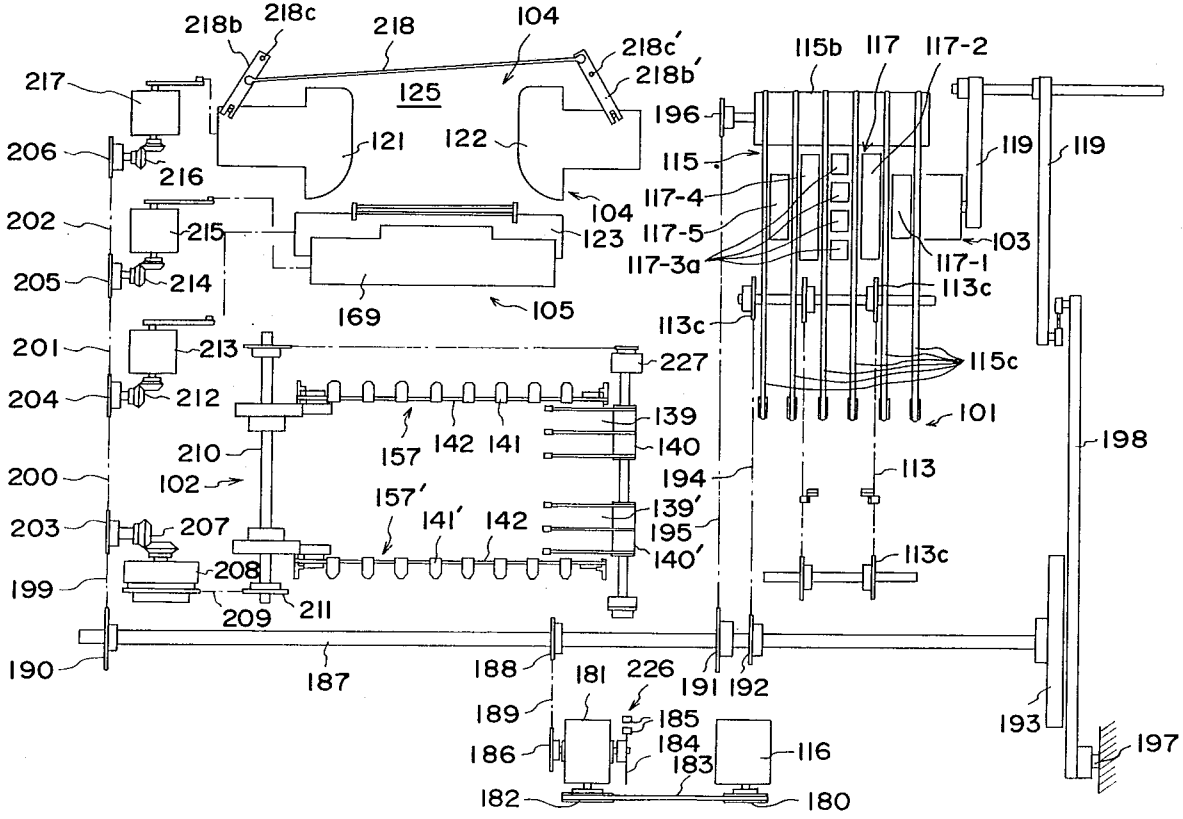
FIG. 9 is a systematic view illustrating the drive system of the wrapping machine.

Parallel guide bars 126, 126; 126', 126' directed toward the opening 125 are provided at the upper portion of the machine frame 110 on opposing longitudinal sides thereof. Slidably provided on the guide bars 126, 126; 126', 126' are sliding members 127, 127, 127', 127', respectively. The left folding plate 121 is attached to the lower portions of the sliding members 127, 127, and the right folding plate 122 is attached to the lower portions of the sliding members 127', 127'. Pivot shafts 218*c*, 218*c'* are provided in close proximity to the respective left and right folding plates 121, 122, as shown in FIG. 9. Rotating rods 218*b*, 218*b'* are pivotably attached to the pivot shafts 218*c*, 218*c'*, respectively. The rear ends of the rotating rods 218*b*, 218*b'* are rotatably connected to the left and right folding plates 121, 122, respectively. The rotating rods 218*b*, 218*b'* are rotatably linked by a link 218, by which the left and right folding plates 121, 122 are simultaneously rotated in mutually opposing directions, that is, either forward toward or backward away from the center of the opening 125.

As shown in FIG. 4, the front folding plate 123 is a flat plate having a front folding roller 123*a* rotatably provided on the side thereof facing the opening 125. Side guide rails 128, 128' are arranged on the machine frame 110 on the left and right sides of the opening 125 and are provided with respective first sliding members 129, 129' and respective second sliding members 130, 130'. The front folding plate 123 is attached astride the first sliding members 129, 129'. The sliding member 129 and a first drive shaft 131 are connected by a crank mechanism 133 so that the front folding plate 123 can be moved toward or away from the rear folding roller 124. The crank mechanism 133 rotatably connects rotating rod 133*a*, which is fixedly secured to the first drive shaft 131, and the rotating rod 133*b*, which is fixedly secured to the sliding member 129, via a pivot shaft 133*c*.

A pusher 169 is attached to the sliding members 130, 130. The pusher 169 is to be moved toward or away from the rear folding roller 124 by a second drive shaft 131' and a crank mechanism 133', just as the front folding plate.

The outfeed conveyance mechanism 105 comprises the pusher 169 for pushing out an article under which the left, right and front edges of a cut length of stretchable film have been folded by the folding mechanism 104, a lateral slider 170 on which the wrapped article pushed out by the pusher 169 is placed for being moved laterally, and a heating belt 171 for heat sealing the bottom of the wrapped article after it has been moved laterally. By being pushed by the pusher 169, the rear edge of the stretchable film is folded under the article by the rear folding roller 124. The article is then placed upon the heating belt 171, where the stretchable film on the bottom of the article is fused to complete the wrapping of the article.

The wrapped article is positioned at the label affixing location of the weighing and pricing machine 300 by the lateral slider 170. As will be described below, the weighing and pricing machine 300 affixes a label to the upper surface of the wrapped article, the label bearing such printed information as the name of the article, its weight and its price. Thereafter, the wrapped and labeled article is fed out of the wrapping machine 100.

A drive system for driving each of the aforementioned sections of the wrapping machine will now be described.

FIG. 9 is a systematic view showing the drive system of the wrapping machine 100. A motor constituting part of the drive system of the wrapping machine 100 is shown at reference numeral 116. Motive power produced by the motor 116 is transmitted from a V pulley 180 secured to the rotary shaft of the motor 116 to a V pulley 182 secured to an input rotary shaft of the speed reducer 181 via a V belt 183. The speed reducer 181 has a first output rotary shaft to which is secured a slitted disk 184, the structure whereof will be described below. Motion of slits formed in the disk 184 is sensed by a sensor 185 to obtain a timing signal for controlling wrapping machine motive power. The speed reducer 181 has a second output shaft to which a sprocket 186 is secured. Motive power is transmitted from the sprocket 186 to a sprocket 188, which is secured to a main drive shaft 187 of the wrapping machine, via a chain 189.

Secured to the main drive shaft 187 are sprockets 190, 191, 192. Also secured to one end of the main drive shaft 187 is a cam 193 for raising and lowering the elevator.

The sprocket 192 transmits motive power to the sprocket 113c of the pusher conveyor 113 via a chain 194, and the sprocket 191 transmits motive power to a sprocket 196 via a chain 195. The sprocket 196 is secured to the rotary shaft of the roller 115b, which applies the motive power to the round rubber belt 115c of the belt conveyor 115. The elevator cam 193 raises and lowers the elevator bed 117 by applying motive power for up and down movement to levers 119, 119 via a drive rod 198 driven up and down about a fulcrum 197 as center. The sprocket 190 transmits power to sprockets 203, 204, 205, 206 via chains 199, 200, 201, 202, respectively. The sprocket 203 transmits power to an electromagnetic clutch brake 208 via a 90° bevel gear 207, and thence via a chain 209 to a sprocket 211 secured to a drive shaft 210 of the film feeding mechanism 102. Thus, drive for rotation is applied to the round rubber belts 142, 142' for embracing the longitudinal edges of the stretchable film and for conveying the same, and to the chain conveyors 157, 157' to which the grippers 141, 141' are respectively attached at the prescribed spacing. The feed belts 139, 139', 140, 140' paying out and supplying the stretchable film are rotated by a driving force received via a electromagnetic clutch brake 227.

The sprocket 204 transmits power to an electromagnetic clutch brake 213 via a 90° bevel gear 212, and the electromagnetic clutch brake 213 transmits the power to the front folding plate 123. The sprocket 205 transmits power to an electromagnetic clutch brake 215 via a 90° bevel gear 214, and the electromagnetic clutch brake 215 transmits the power to the pusher 169. The sprocket 206 transmits power to an electromagnetic clutch brake 217 via a 90° bevel gear 216, and the electromagnetic clutch brake 217 transmits drive to the left and right folding plates 121, 122 via the sliding members 127, 127' and crank mechanism 218 to move the folding plates 121, 122 toward and away from the center of the opening 125.

Thus, the drive system of the wrapping machine 100 is composed of mutually independent drive means that act through the electromagnetic clutch brakes 208, 213, 215, 217. Accordingly, if the wrapping machine 100 is shut down for an emergency caused by an accident such as the turnover or jamming of an article, the electromagnetic clutch brakes 208, 213, 215, 217 can be released by pressing a clutch release button on the control panel. This enables the various elements constituting the film feed mechanism 102, folding mechanism 104 and conveyance mechanism 105 to be moved individually by hand, thereby simplifying the removal of the turned over or jammed article and greatly shortening the time required to restore the wrapping machine to operation.

In the foregoing embodiment, the independent drive means illustrated transmit the power from the motor 116 through the intermediary of the electromagnetic clutch brakes 208, 213, 215, 217. However, reversible motors can be used in place of the motor 116 and electromagnetic clutch brakes 208, 213, 215, 217 and the various elements of the wrapping machine can be actuated automatically by appropriate selection of the rotating direction of these motors.

The weighing and pricing machine 300 includes the aforementioned labeler which, on the basis of information from the weigher 114 of the wrapping machine 100 and information entered from the console 301, prints various information relating to an article on a label and affixes the label to the wrapped article. Since the mechanical structure of the weighing and pricing machine is well-known in the art and is not directly related to the present invention, a description thereof is deleted.

Figure 1:
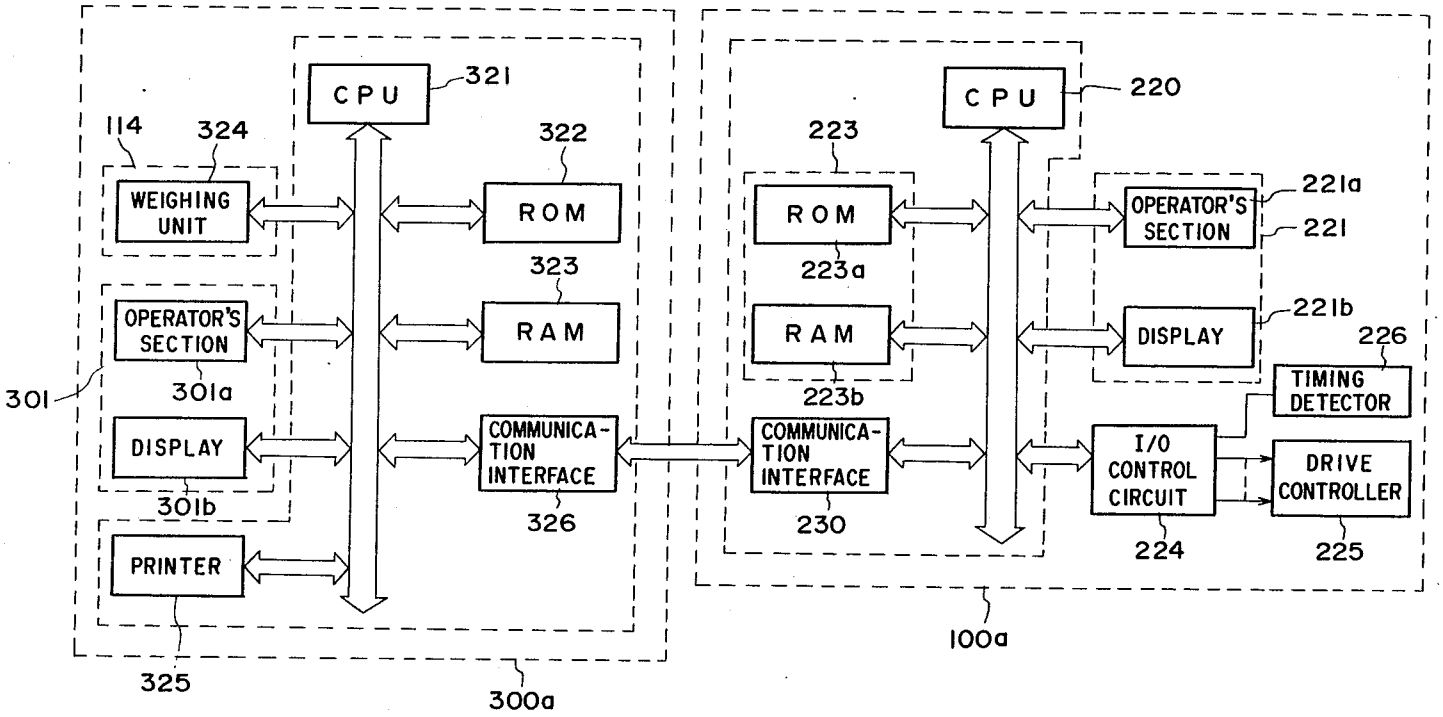
FIG. 1 is a block diagram illustrating the construction of a control unit in a wrapping system according to the present invention.

FIG. 1 is a block diagram illustrating the configuration of an apparatus in accordance with the present invention for controlling the wrapping apparatus having the wrapping machine 100 and the weighing and pricing machine 300. As shown, the control apparatus is composed of a control unit 300a for controlling the weighing and pricing machine 300, and a control unit 100a for controlling the wrapping machine 100. The wrapping machine control unit 100a is constituted by a central processor 220, a control and display panel 221, a memory unit 223, an input/output control circuit 224, a drive controller 225, a timing detection circuit 226, and an interface 230 for communication with the weighing and pricing machine control unit 300a. The memory unit 223 includes a read-only memory (ROM) 223a and a random-access memory 223b and the control and display panel 221 includes an operator's section 221a and a display 221b.

A printer 325 has a printing unit for printing predetermined data on a label adhered to a backing sheet, and a label affixing unit for holding, under the application of suction, a printed label peeled from the backing sheet, and for applying a blowing force to the label at a predetermined timing.

The control unit 300a of the weighing and pricing machine 300 comprises a read-only memory (ROM) 322, a random-access memory (RAM) 323, a weighing unit 324, the console 301, the printer 325 and an interface 326 for communicating with the wrapping machine control unit 100a. The weighing unit 324 is the weighing unit of the weigher 114 provided on the infeed conveyance mechanism of the wrapping machine 100. The console 301 has an operator's section 301a and a display 301b.

Signals are exchanged between the control unit 100a of the wrapping machine 100 and the control unit 300a of the weighing and pricing machine 300 through the interfaces 230, 326.

Figure 12A:
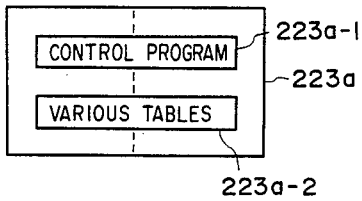
FIG. 12(A) is a conceptual view illustrating the configuration of a read-only memory (ROM) in the wrapping machine control unit.
Figure 12B:
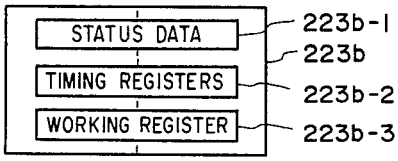
FIG. 12(B) is a conceptual view illustrating the configuration of a random-access memory (RAM) in the wrapping machine control unit.

The ROM 23a of the wrapping machine control unit 100a has a control program storage area 223a-1 storing a control program, and a table storage area 223a-2 storing various tables, described below. The RAM 223b includes a status data storage area 223b-1 for storing status data, an operating timing register 223b-2 for storing various timing data, and a working register 223b-3 [see FIGS. 12(A), (B)].

Figure 13A:
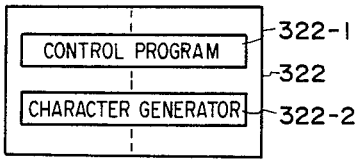
FIG. 13(A) is a conceptual view illustrating the configuration of a read-only memory (ROM) in a weighting and pricing machine control unit.
Figure 13B:
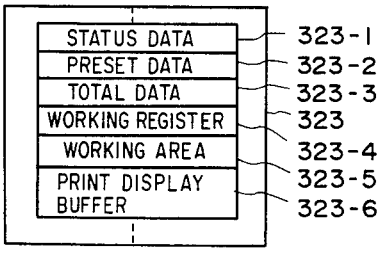
FIG. 13(B) is a conceptual view illustrating the configuration of a random-access memory (RAM) in a weighting and pricing machine control unit.

The ROM 322 in the weighing and pricing machine control unit 300a includes a control program storage area 332-1 storing a control program, and a character generator 322-2 for the label printer. The RAM 323 includes a status data storage area 323-1, a preset data storage area 323-2 for storing preset data, described below, a total data storage area 323-3 for storing total data, a working register 323-4, a working area 323-5 for storing working data, and a print display buffer 323-6 [see FIGS. 13(A), (B)].

In the above control apparatus, film length, film tension and tray type data are stored beforehand, in correspondence with numbers of articles to be wrapped, in the RAM 323a of the weighing and pricing machine 300, as will be described in detail later. In response to entry of the number of an article to be wrapped from the operator's section 301*a*, the central processor 220 of the wrapping machine 100 calls the film length, tension and tray type data corresponding to this number, controls the drive controller 225 via the input/output control circuit 224, thereby controlling the operating timing of the various operating elements of the wrapping machine 100 so that the machine will wrap the article into an attractive package at all times irrespective of the size and shape of the article. The construction and operation of the control units 100*a*, 300*a* of the wrapping machine 100 and weighing and pricing machine 300 will now be described in detail.

Figure 10:
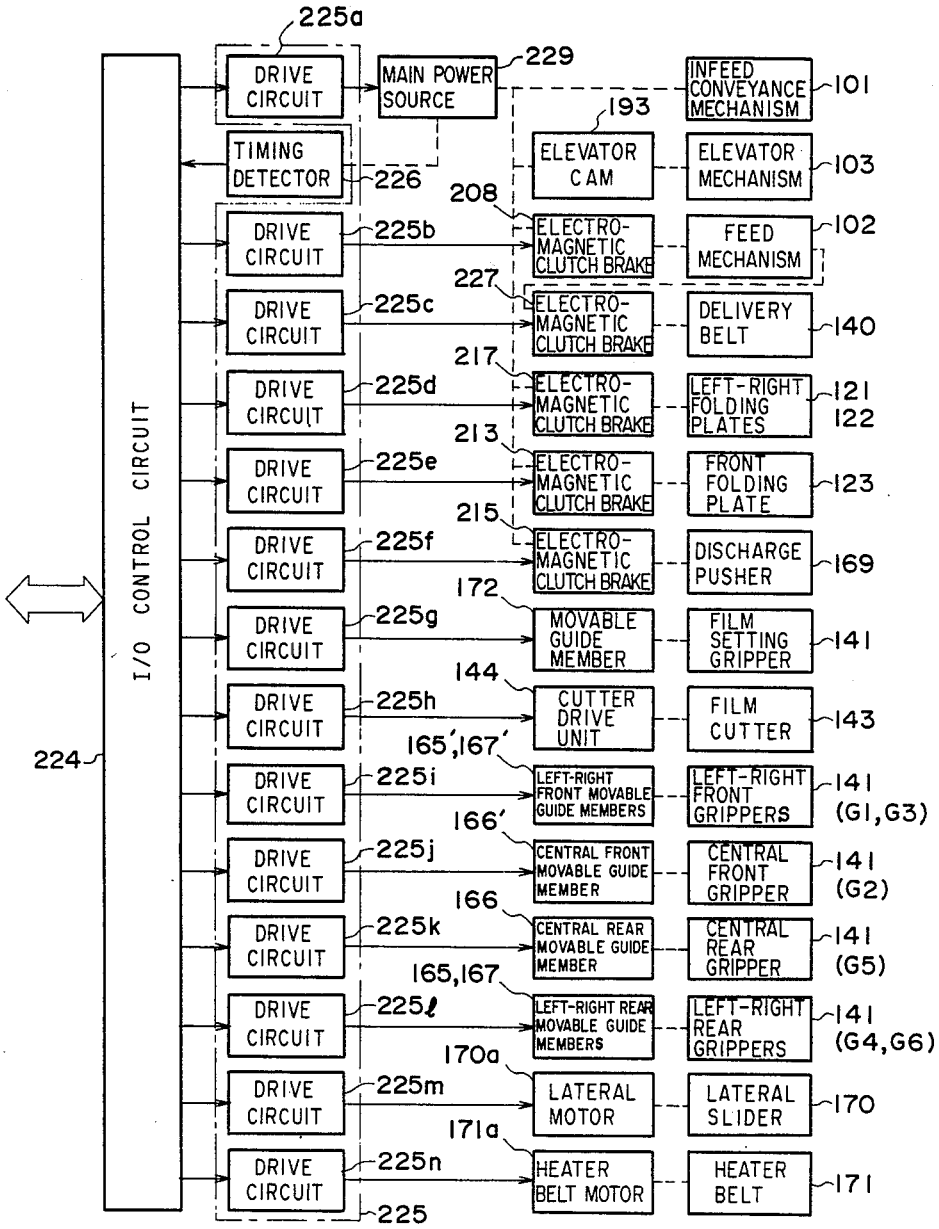
FIG. 10 is a block diagram illustrating a controller connected to an input/output control circuit of the wrapping machine control system.

FIG. 10 is a block diagram illustrating the controller connected to the input/output control circuit 224 of the wrapping machine 100. The solid line arrows in FIG. 10 indicate the transmission of electrical signals, while the dashed lines indicate transmission of a mechanical variety.

The drive controller 225 is composed of drive circuits 225*a*–225*n*. The drive circuit 225*a* drives a main power unit 229, which is composed of the motor 116 and speed reducer 181. The arrangement is such that a mechanical driving force from the main power unit 229 is transmitted to the infeed conveyance mechanism 101, elevator cam 193 and electromagnetic clutch brakes 208, 213, 215, 217 and 227. The drive circuit 225*b* is for energizing the electromagnetic clutch brake 208 that drives the film feed mechanism 102. The drive circuit 225*c* is for driving the electromagnetic clutch brake 227, which drives the film feeding belt 140. The drive circuit 225*d* is for energizing the electromagnetic clutch brake 217 that operates the left and right folding plates 121, 122. The drive circuit 225*e* is for energizing the electromagnetic clutch brake 213 that drives the front folding plate 123. The drive circuit 225*f* is for energizing the electromagnetic clutch brake 215 that drives the discharge pusher 169. The drive circuit 225*g* is for driving the movable guide member 172, which drives the film setting gripper 141. The drive circuit 225*h* is for energizing a cutter drive unit 144, which drives the cutter 143. The drive circuit 225*i* operates the left and right movable guide members 165', 167' to open the grippers 141 (hereafter referred to as left and right front grippers G1, G3, respectively) engaging with the movable guide members 165', 167'.

The drive circuit 225*j* operates the central front-side movable guide member 166' to open the gripper 141' (hereafter referred to as a central front gripper G2) engaging with the movable guide member 166'. The drive circuit 225*k* operates the central rear-side movable guide member 166 to open the grippers 141 (hereafter referred to as a central rear gripper G5) engaging with the movable guide member 166.

The drive circuit 1251 drives the left and right rear-side movable guide member 165, 167 to open the grippers 141 (hereafter referred to as left and right rear grippers G4, G6) engaging with the movable guide members 165, 167.

The timing detector 226 detects a signal from a timing signal generator comprising the slitted disk 184, which is secured to the rotary shaft of the speed reducer 181 of FIG. 9 for correlating with the rotary shaft, and the sensor 185. The timing detector 226 detects this timing signal, which is for driving the various operating elements of the wrapping machine 100, such as the left, right and front folding plates 121, 122, 123, respectively, of the wrapping machine.

On the basis of a timing signal from the timing detector 226 and data stored in an operation timing table, which has been stored in the table storage area 223*a*-2 of the ROM 223*a* in memory unit 223, the central processor 220 transmits signals to the drive circuits 225*a*–225*n* through the input/output control circuit 224 to drive the various elements of the wrapping machine, such as the film feeding mechanism 102 and folding mechanism 104, at a predetermined timing.

Figure 11:
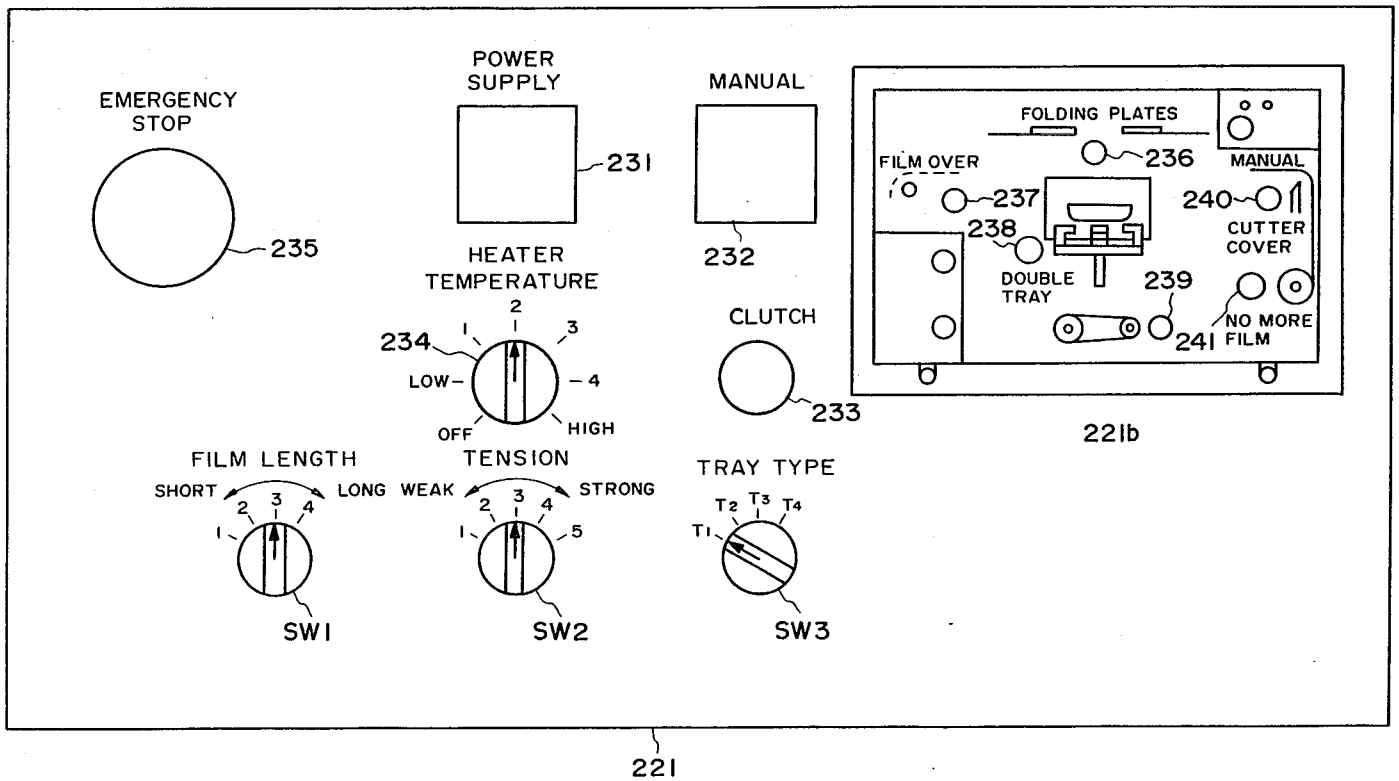
FIG. 11 is a view showing the external appearance of a control and display panel.

FIG. 11 is a view showing the external appearance of the control and display panel 221. The control and display panel 221 is provided with a power supply switch 231 for introducing power, a manual operation button 232, a tray type changeover switch SW3 for changing over tray type, a film tension adjustment switch SW2 for adjusting film tension, a film length setting switch SW1 for setting the length to which the film is cut, a release switch 233 for releasing the electromagnetic clutch brake 208 and the like, a heater temperature adjustment switch 234 for adjusting the temperature of the heat belt 171, and an emergency stop switch 325. These switches constitute the operator's section 221*a*.

The display 221*b* is for verifying the operating status of each of the main mechanisms and includes a folding plate indicating lamp 236 for displaying the status of the left and right folding plates 121, 122, a film over indicating lamp 237 indicating the status of the film, a double tray indicating lamp 238 indicating a double tray, and overload indicating lamp 239 indicating overloading of the wrapping machine 100, a cutter cover indicating lamp 240 indicating that the cutter 143 is covered by a cover, and an end-of-film indicating lamp 241 indicating that there is no more film left.

The tray type changeover switch SW3 is set depending upon tray type, which is divided into four categories, namely a standard tray T1, a square tray T2, a small tray T3, and a long tray T4. The film tension adjusting switch SW2 can be set to any one of five stages of film tension ranging from strong to weak in order adjust tension. Left-right film tension is determined, by the operation timing of the left and right front grippers and left and right rear grippers, and tension on the front side of the film is determined by the operation timing of the central front gripper. More specifically, each of these operation timings is changed by the film tension adjustment switch SW2. The film length setting switch SW1 can be set to any one of four stages of film length ranging from long to short in order to adjust the length.

It should be noted that the setting of the tray type changeover switch SW3 take preference over the settings of the film tension adjusting switch SW2 and film length setting switch SW1. In other words, these switches are interrelated and are not adjusted independently of one another. For example, even if the film length setting switch SW1 is set to "3", the actual cut length of the film will differ depending upon whether the tray type changeover swtich SW3 is set to STANDARD or SMALL.

Trays now in common use may be classified broadly into four types, namely standard trays T1, square trays T2, small trays T3 and long (slender) trays T4, as shown in FIGS. 14(A), (B), (C) and (D). The standard tray T1 has a standard length-to-width ratio. The square tray T2 is one whose four sides are of equal length. The small tray T3 is for accommodating very small articles, and the long tray T4 is for accommodating articles of considerable length. Assuming that the four categories of cut film length in progressively larger order are A, B, C and D, cut film length designated by the graduations 1, 2, 3 and 4 of the film length setting switch SW1 will be rendered as shown in FIG. 15 by setting the tray type changeover switch SW3 to T1 (standard), T2 (square), T3 (small) and T4 (long). Further, assume that the five categories of left and right front-side clamping mechanism release timing in progressively slower order are a, b, c, d and e. Then, by setting the tray type changeover switch SW3 to T1 (standard), T2 (square), T3 (small) and T4 (long), left and right front gripper release timing will be rendered as shown in FIG. 16 by setting the film length setting switch SW1 to 1–5 in a case where the film tension adjustment switch SW2 is set to "3". Thus, what is indicated by the graduations of the film length setting switch SW1 and film tension adjustment switch SW2 is changed by designating the tray type through use of the tray type changeover switch SW3 is to obtain an attractively wrapped package irrespective of the tray type category.

When the cut film lengths A–D are determined by the tray type changeover switch SW3 and film length selection switch SW1 as shown in FIG. 15, the timing Tm at which the left and right folding plates 121, 122 are actuated is decided as shown in, e.g., FIG. 17, in dependence upon the cut film lengths A–D. The numerical values representative of the operation timing Tm indicate the angle of rotation of the slitted disk 184, namely the count of pulse signals from the timing detector circuit 226 (where one pulse is produced for every 5° of rotation of the slitted disk 184).

Selection of operation timing of the film feed mechanism, release timing for the left and right grippers and operation timing Tm of the left and right folding plates 121, 122 is performed entirely on the basis of the tables, illustrated in FIGS. 15, 16 and 17, stored in the table storage area 232*a*-2 of the ROM 223*a* in the wrapping machine control unit 100*a*. The central processor 220 performs a monitoring operation to determine whether the count of pulse signals from the main timing detector circuit 226 has been updated. When the count is updated, the central processor 220 determines whether the count agrees with the timing values decided on the basis of the tables and, when agreement is found to exist, executes the particular process.

Thus, the selection of cut film length, tension and tray type in conformance with the size and shape of the article to be wrapped, which is effected by operating the film length setting switch SW1, film tension adjustment switch SW2 and tray type changeover switch SW3 of the control and display panel 211, for the purpose of obtaining an attractively wrapped article is as set forth in the specification of the already filed Japanese Patent Application No. 60-24686, which is related to the present application. However, performing wrapping by operating the switches SW1, SW2, SW3 whenever the article to be wrapped changes is a troublesome task, as mentioned above. Therefore, in accordance with the present invention as embodied herein, data indicative of predetermined film lengths, film tensions and tray type are stored in the preset data storage area 323-2 of the RAM 323*a* in the weighing and pricing machine control unit 300*a* in correspondence with the article numbers assigned to articles to be wrapped, as mentioned above. By entering the number of an article to be wrapped from the operator's section 301 of the weighing and pricing machine control unit 300*a*, the corresponding film length, film tension and tray type data are called from the preset data storage area 323-2 and the operation timing of the various wrapping machine operating elements is controlled on the basis of these data.

Further, according to the illustrated embodiment, when the data designating film length, film tension and tray type are stored in the preset data storage area 232-2 in correspondence with the article numbers, these data are not stored directly. Rather, in order that the data may be set in a simple manner, a wrapping parameter WCP having one-to-one correspondence with each combination of data is stored. Then, by entering an article number, the wrapping parameter WCP preset in correspondence with this number is read out and the film length, film tension and tray type data are decided on the basis of the wrapping parameter WCP. A specific example of this will now be described.

Figures 18, 19, 20:
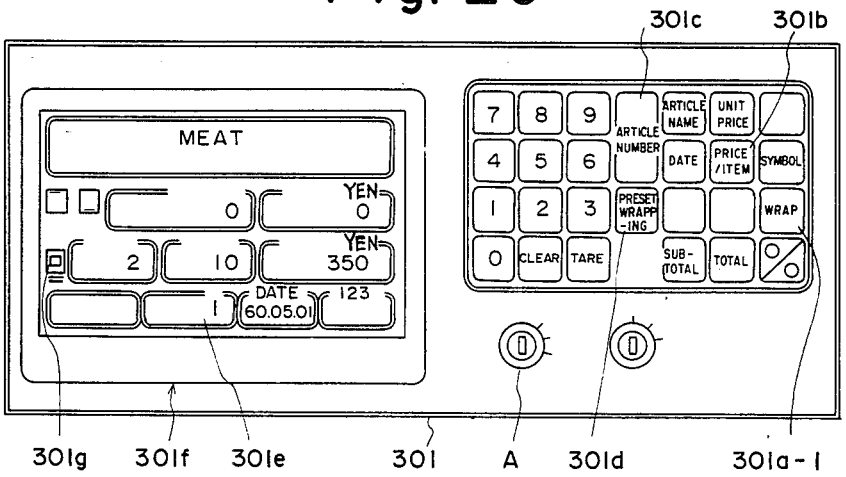
FIG. 18 is a view showing the relationship among a wrapping parameter WCP, switches SW1, SW2, SW3 and graduations.
FIG. 19 is a view showing the relationship between information indicative of articles to be wrapped and a wrapping parameter WCP.
FIG. 20 is a view showing the external appearance of the console of weighing and pricing machine control unit.

FIG. 18 is a table illustrating combinations of film cut length, film tension and tray type set by the film length setting switch SW1, film tension adjustment switch SW2 and tray type changeover switch SW3 in correspondence with the aforementioned wrapping parameter WCP. The table is stored in the abovementioned table storage area of the ROM 223*a* of wrapping machine control unit 100*a*. As for the number assigned to the wrapping parameter WCP, film cut length, film tension and tray type combinations that appear with great frequency for articles that are to be wrapped are allotted low parameter numbers, and those that appear with little frequency are allotted high parameter numbers. In this way wrapping parameters WCP often used the operator can readily be remembered by.

As shown in FIG. 19, data indicative of articles to be wrapped, such as unit price, tare (the weight of the tray used) and article name, as well as the wrapping parameter WCP, are preset as preset data, in correspondence with the article numbers, in the preset data storage area 323-2 of the RAM 323 in the weighing and pricing machine control unit 300*a*. To set these preset data in the preset data storage area 323-2 of RAM 323, the operator manipulates a cylinder key A on the console 301 (FIG. 20) of the weighing and pricing machine 300, thus establishing a setting mode, and then inputs the article number, unit price, tare, article name, etc., followed by the wrapping parameter WCP.

Let us now describe, in sequence, the wrapping of articles performed by the wrapping apparatus set forth above.

(1) First, the wrapping machine 100 and weighing and pricing machine 300 are placed in a communicating state or, in other words, the interfaces 230, 326 are put into communication with each other. This is accomplished by pressing a wrap key 301*a*-1 on the console 301.

(2) If it is now desired simply to affix a price without the wrapping machine 100 performing a wrapping operation (i.e. if the wrapping machine is to be used as a conveyance device), a pricing/item key 301*b* is pressed. The states established by steps (1) and (2) are indicated by a symbol which appears at a predetermined position 301*g* of a display panel 301*f* on the console 301.

(3) Next, the operator inputs the article number of an article to be wrapped. If the article to be wrapped is a meat product having an article number "2", for example, the operator presses a numeric key "2" and then an article number key 301*c*. As a result of this operation, data corresponding to the article number 0002 are called, with the article number serving as a retrieval key, from the preset data (FIG. 19) stored in the preset data storage area 323-2 of RAM 323, and these data are stored in the working register 323-4 at locations corresponding thereto. More specifically, in the case of FIG. 19, data corresponding to the article number "0002", namely unit price "350", tare "10", product name "MEAT" (actually a character code) and wrapping parameter WCP "01", are called from the RAM 323 are stored in the working register 323-4. Of the data stored in the working register 323-4, the wrapping parameter WCP "01" is transferred to the wrapping machine control unit 100*a* via the interfaces 326, 230.

(4) The wrapping machine control unit 100*a* monitors present status at all times in accordance with a main processing routine program stored in the control program storage area 223*a*-1 of the ROM 223*a*. For a case where the weighing and pricing machine 300 is connected thereto, the control unit 100*a* reads in the wrapping parameter WCP sent from the weighing and pricing machine 300, refers to the table, shown in FIG. 18, stored in the table storage area 223*a*-2 of the ROM 223*a*, investigates the film length setting switch SW1, film tension adjustment switch SW2 and tray type changeover switch SW3 on the basis of the wrapping parameter WCP, and determines the operation timing of each operating element of the wrapping machine 100 corresponding to the wrapping parameter WCP, which timing is specified by the graduations to which the switches SW1, SW2, SW3 have been set (in the illustrated embodiment, SW1=3, SW2=4, SW3=T1). In other words, on the basis of the settings of switches SW1, SW3, the cut film lengths A through D are obtained by referring to the table shown in FIG. 15. Further, on the basis of the settings of switches SW1, SW2, SW3, the release timings a, b of the front, left and right grippers, which decide the degree of film tension, are obtained by referred to the table of FIG. 16 and other tables. Then, on the basis of the cut film lengths A through D obtained, the operation timings of the left and right folding plates 121, 122 are found by referred to the table shown in FIG. 17. The operation timings found in this manner are stored in the operation timing registers 223*b*2 of RAM 223*b*. (The particulars of these operations are set forth in the specifications of Japenese Patent Application Nos. 59-204743, 59-204744 and 60-24686 filed previously by the applicant and, for this reason, they are not described in detail here.)

(5) When an article to be wrapped is placed upon the weigher 114 disposed on the pusher conveyor 113 of the infeed conveyance mechanism 101, the weigher 114 sends a signal indicative of the weight of the article to the central processor 321 of the weighing and pricing machine control unit 300*a*. Upon determining that the weight value indicated by the weigher 114 has stabilized, the central processor 321 transfers a weight stability signal to the wrapping machine 100.

(6) In response to the weight stability signal from the weighing and pricing machine control unit 300*a*, the wrapping machine 100 starts an article wrapping operation. At this time the operation timings of the various operating elements of the wrapping machine 100 are obtained in step (3) described above and control is effected in accordance with the operation timings stored in the operation timing registers 223*b*-2 of RAM 223*b*.

(7) Meanwhile, the weighing and pricing machine control unit 300*a* calculates net weight from the weight value produced by the weigher 114 and a tare value called to the working register 323-4, calculates the price of the article from the net weight and unit price, and issues a label on which the price is printed.

(8) Articles are wrapped in the stretchable film tray by tray and are moved laterally by the lateral slider 170. Thereafter, the stretchable film on the bottom of a wrapped article is fused by the heat belt 171 and the price label issued in step (7) is affixed to the wrapped article at a predetermined location thereon by the labeler of the weighing and pricing machine 300.

(9) If the operator wishes to change wrapping conditions such as the cut film length, tension and tray type in the state prevailing in step (3), this can be accomplished by changing the wrapping parameter WCP. For example, if the wrapping parameter WCP is to be changed from "1" to "2", the operator presses the numeric key "2" and then presses the preset wrapping key 301*d* (see FIG. 18), whereby the wrapping parameter WCP called to the working area 323-5 can be altered temporarily without changing the wrapping parameter WCP of the preset data (see the table of FIG. 17) stored in the preset data storage area 323-2 of RAM 323. This state is indicated by a display section 301*e* (FIG. 20) on the console 301.

(10) The cut film length, film tension and tray type data can be set by the switches SW1, SW2, SW3 of the wrapping machine 100 in the state prevailing in step (3). Specifically, in a case where the data set by the switches SW1, SW2, SW3 on the side of the wrapping machine 100 are to be made effective in a state where the working parameter WCP has been called, the preset wrapping key 301*d* is pressed without pressing a numeric key. As a result of this operation, the values to which the switches SW1, SW2, SW3 of the wrapping machine 100 have been set are used as the cut film length, tension and tray type data. The operation timings of the various wrapping machine elements are determined by these values. This state is indicated by the display section 301*e* of the console 301. It should be noted that if the called wrapping parameter WCP is to be rendered effective again, all that need be done is to press the preset wrapping key 301*d* again.

Figure 21:
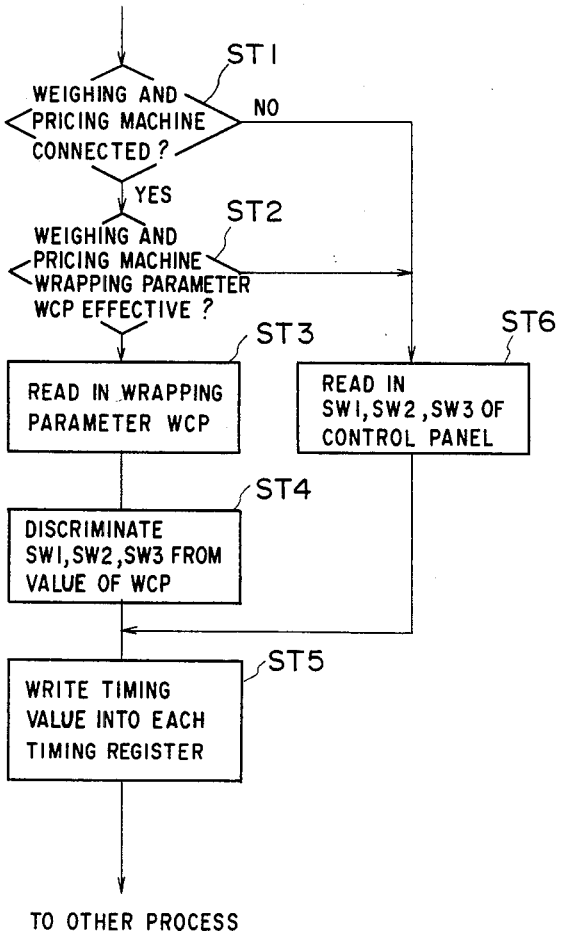
FIG. 21 is a flowchart illustrating wrapping processing performed by the wrapping machine.

FIG. 21 is a flowchart illustrating the main features of the wrapping process performed by the wrapping machine 100. The first step is designated ST1, at which it is determined whether the wrapping machine is connected to the weighing and pricing machine 300. If the decision here is affirmative, then it is determined at a step ST2 whether the wrapping parameter WCP of the weighing and pricing machine 300 is effective. If the answer here is YES, then, at a step ST3, the wrapping machine 100 reads in the wrapping parameter WCP sent by the weighing and pricing machine 300. This is followed by a step ST4, at which the values of the switches SW1, SW2, SW3 are determined from the value of the wrapping parameter WCP that has been read in. Next, at a step ST5, the timing values determined by the switches SW1, SW2, SW3 are written into the timing registers 223*b*-2. This is followed by other processing. If the weighing and pricing machine 300 is found not to be connected at step ST1, the next step executed is a step ST6, at which the values of the switches SW1, SW2, SW3 on the control and display panel 21 of wrapping machine 100 are read in. This is followed by the step ST6.

Figure 22:
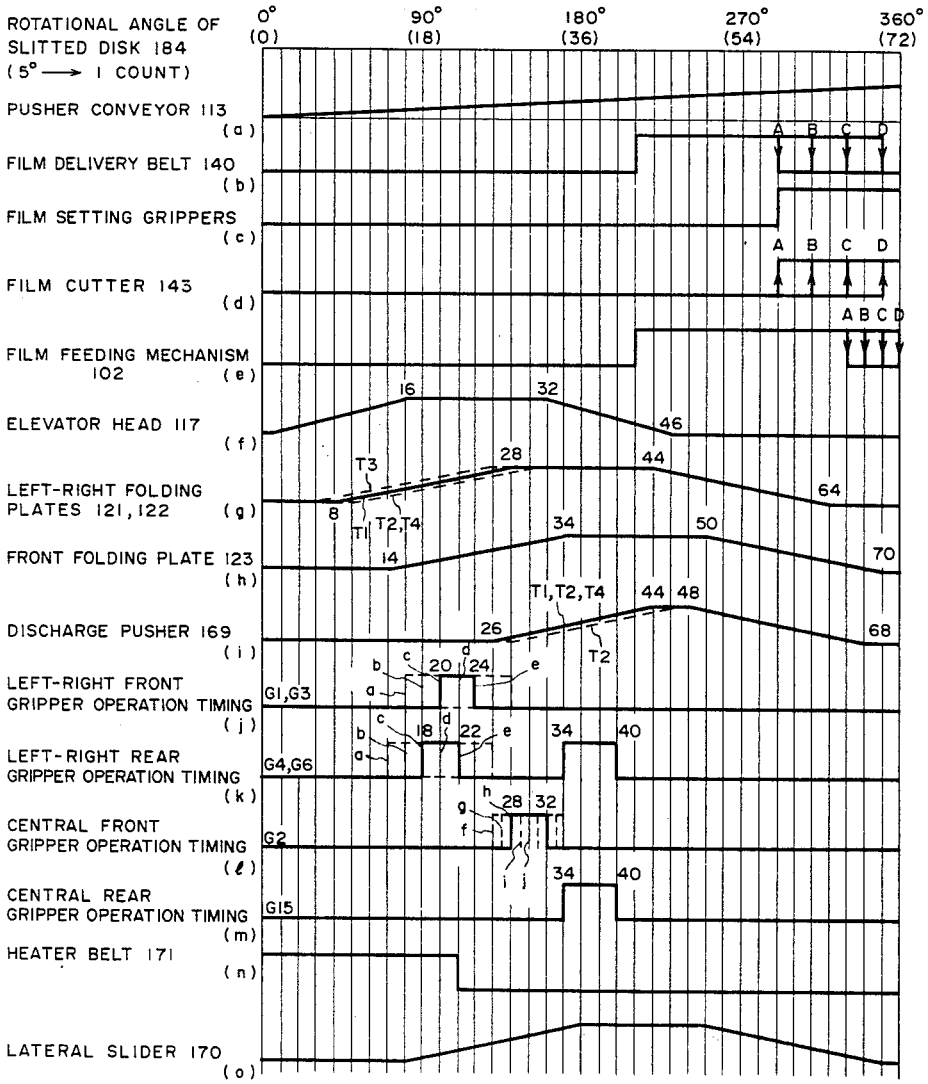
FIG. 22 is a mechanical chart illustrating the operation of various operating sections of the wrapping machine.

FIG. 22 is a mechanical chart illustrating an example of operations performed by the operating elements of the wrapping machine 100. It is assumed in the Figure that the timing detector circuit 226 produces one pulse each time the slitted disk 184 rotates by 5°. The slitted disk 184 outputs one pulse each time it rotates through 5°.

The pusher conveyor 113 rotates continuously from count 0 to count 72, whereby an article on the weigher 114 is transferred to the elevator head 117 [(a) in FIG. 22]. The delivery belt 140 starts at a count 42 and stops at counts 58, 62, 66, 70 corresponding to the cut film lengths A, B, C, D [(b) in FIG. 22]. The film setting grippers are released at count 58 (i.e. the guide members 172, 172' are actuated) [(c) in FIG. 22]. The film cutter 143 is actuated at counts 58, 62, 66, 70 corresponding to the cut film lengths A, B, C, D [(d) in FIG. 22].

The film feeding mechanism 102 starts operating at count 42 and stops operating at counts 66, 68, 70, 72 corresponding to the cut film lengths A, B, C, D [(e) in FIG. 22].

The elevator bed 117 begins ascending at count 1, reaches its uppermost position at count 16, begins descending at count 32 and reaches its lowermost position at count 46 [(f) in FIG. 22].

The operation timing of the left and right folding plates 121, 122 differs depending upon the tray type, namely the standard tray T1, square tray T2, small tray T3 and long tray T4. For the standård tray T1, the left and right folding plates begin advancing at count 8, finish advancing at count 28, begin withdrawing at count 44 and finish withdrawing at count 64, as indicated by the solid line at (g) in FIG. 22. For the small tray T3, the left and right folding plates begin advancing at count 6 and finish advancing at count 26, as indicated by the dashed line at (g) in FIG. 22. For the square tray T2 and long tray T4, the left and right folding plates being advancing at count 10 and finish advancing at count 30.

The front folding plate 123 begins advancing at count 14, finishes advancing at count 34, begins withdrawing at count 50 and finishes withdrawing at count 70, as indicated at (h) in FIG. 22.

The operation timing of the discharge pusher 169 differs depending upon the tray type. For the standard tray T1, small tray T2 and long tray T4, the discharge pusher 169 begins advancing at count 24, finishes advancing at count 44, begins withdrawing at count 48 and finishes withdrawing at count 68, as indicated by the solid line at (i) of FIG. 22. For the square tray T2, the discharge pusher 169 begins advancing at count 28 and finishes advancing at count 46, as indicated by the dashed line at (i) of FIG. 22.

As for the operation timing of the left and right front grippers G1, G3, the grippers open at count 20 and close at count 24, as indicated by the solid line at (j) of FIG. 22, for the case where the tray is the most standard tray. The left and right rear grippers G4, G6, on the other hand, open at count 18 and close at count 22. In other words, the left and right front grippers G1, G3 open earlier, namely by a count of 2, than the left and right rear grippers G4, G6. Further, depending upon the tray type, cut film length and film tension, the left and right front grippers G1, G3 and the left and right rear grippers G4, G6 each operate at five different opening timings a, b, c, d and e, indicated by the dashed lines, centered on the timing shown by the respective solid lines (see FIG. 16).

The central front gripper G2 opens at count 28 and closes at count 32, as indicated by the solid line at (1) of FIG. 22, for the case where the tray is the most standard tray. The central front gripper G2 operates at five different opening timings f, g, h, i, j, indicated by the dashed line, in dependence upon the tray type, cut film length and tension.

The central rear gripper G5 opens at count 34 and closes at count 40, as shown at (m) of FIG. 22. The left and right rear grippers G4, G6 likewise open at count 34 and close at count 40. This operation of the left and right rear grippers G4, G6 is a safety measure for the purpose of completely releasing the film.

The operation timings of the heat belt 171 and lateral slider 170 are as indicated at (n) and (o), respectively, in FIG. 22.

In the illustrated embodiment, the table of graduations of the switches SW1, SW2, SW3 corresponding to the wrapping parameter WCP in FIG. 18 is stored in the ROM **223*a* of the wrapping machine control unit 100*a*, the wrapping parameter WCP is stored as the preset data of the weighing and pricing machine 300 in the RAM 323, as shown in FIG. 19, and the preset data is called and the wrapping parameter WCP is transferred to the wrapping machine 100 by inputting an article number from the operator's section 301*a* of the weighing and pricing machine 300, thereby setting the various operation timings of the wrapping machine. The reason for this is to dispense with some of the many operator tasks, required in the prior art, when using the apparatus. Specifically, from the necessity of setting various data such a unit price and product name corresponding to an article number, these data are stored beforehand as preset data in the weighing and pricing machine 300, and the data are called and used with the article number serving as a retrieval key. However, by storing the table of FIG. 18 in the ROM 223*a* of the wrapping machine control unit 100*a*, storing the wrapping parameter WCP in the RAM 223*b* of the wrapping machine control unit 100*a* in dependence upon the article number, and entering an article number from the control and display panel 221, operation of the various operating elements of the wrapping machine 100 can be controlled, just as in the above-described embodiment. By adopting such an arrangement, an article can be attractively wrapped without the abovementioned troublesome operation of setting the switches SW1, SW2, SW3 to optimum values whenever an article to be wrapped is changed, even in a case where the wrapping machine 100 is not used in combination with the weighing and pricing machine 300. Conversely, it is of course permissible to store the table of FIG. 18 in the ROM 322*a* of the weighing and pricing machine control unit 300*a* and store the preset data of FIG. 19 in the RAM 323 of the control unit 300*a***.

Further, in the illustrated embodiment, an arrangement is adopted in which the wrapping parameter WCP is set as the preset data and the values of the switches SW1, SW2, SW3 are decided on the basis of this wrapping parameter. As mentioned earlier, this is arrangement is for taking into account the operation efficiency when the data are preset. However, the present invention is not limited to this arrangement. It is obvious that the object and advantages of the invention can be attained even if the arrangement is such that the values per se of the switches SW1, SW2, SW3 are set directly as preset data. In such case, the operation efficiency when the preset data are set will be sacrificed to some extent, but the table for converting the wrapping parameter WCP to the switches SW1, SW2, SW3 will be unnecessary.

In the illustrated embodiment, a case was described in which film length, film tension and tray type are the data capable of being set in correspondence with articles to be wrapped. However, the invention is not limited to such an example, for the wrapping machine 100 can be controlled by taking into account additional factors, e.g. data indicative of the height of an article to be wrapped and the tray materal.

Let us describe an arrangement which takes the height of an article into account. In a case where trays accommodating articles to be wrapped are the same, the amount of the article accommodated, namely the article weight, has an influence upon height. Accordingly, an arrangement can be adopted in which a plurality of wrapping parameters WCP are preset for each article number, and the wrapping parameters are selected and used depending upon the weight value, thereby enabling wrapping to take place with a film length and wrapping timing that take into account the amount of the article accommodated, namely the height of the article.

It is also possible to conceive of an arrangement in which a single basic wrapping parameter WCP is preset in correspondence with each article number and both film length and the control timing of each operating element are decided based on the wrapping parameter WCP and weight value.

In the illustrated embodiment, the wrapping parameter WCP is displayed for verification on the display 301*b* of the weighing and pricing machine 300 when preset data are called. However, it may be arranged so that the values of the switches SW1, SW2, SW3 are displayed directly. In order to improve operability when setting the wrapping parameter WCP, it is possible to successively display the correspondence between the wrapping parameter WC and each of the switches SW1, SW2, SW3 on the display 301*b*.

In order to obtain an attractively wrapped package, the operation timing of the left and right grippers at the front and rear, and the operation timing of the central front gripper is adjusted in dependence upon the tray type and cut film length, thereby regulating the tension of the film wrapping the article. However, as is well known, such characteristics as the degree of elongation of a stretchable film vary with temperature. In the film folding control system of the above-described apparatus, a change in temperature during the wrapping operation will cause a change in film tension, even if the film tension of the package is optimally adjusted at a certain temperature at the start of wrapping. In particular, if wrapping is carried out at a temperature lower than that which prevailed when the initial adjustment was made, the film wrapping the package will develop wrinkles due to a decline in the degree of film elongation. This detracts from the appearance of the package and can make it impossible to wrap the article in extreme cases. If wrapping is performed at a temperature higher than that which prevailed when the initial adjustment was made, on the other hand, the degree of film elongation increases and film tension becomes excessive. The result is a tendency toward tray deformation. Accordingly, in order to deal with this problem, an arrangement can be conceived in which a temperature sensor is provided near the film roll to sense temperature, with the operation timing of the left and right grippers at the front and rear and the operation timing of the central front gripper being corrected based on an output from the temperature sensor, thereby adjusting film tension. Such an arrangement can provide an attractively wrapped package without relation to changes in temperature.

Let us now describe a specific example of such a correction for temperature applied to operation timing of the abovementioned grippers. As shown in FIG. 23, a table of timing correction values Cv corresponding to predetermined temperature ranges T is prepared, the table is stored in the table storage area 223*a*-2 of the ROM 223*a* in the wrapping machine control unit 100*a*, and one of the timing correction values Cv is selected based on the output of the temperature sensor, thereby adjusting the operation timing of the abovementioned grippers. As an example, the correction value will be +1 if the wrapping machine is used at a temperature below 9° C., as may be the case on a winter morning. Therefore, the grippers are opened at a timing delayed by 1. Conversely, the grippers will be opened at a timing advanced by 1 when the temperature is between 20° C. and 29° C.

According to the present invention as described above, the operator merely inputs the article number of an article to be wrapped, and the control section reads the film length, film tension and tray type data out of the memory means and controls the operation timings of the various wrapping machine elements such as the folding mechanism and grippers on the basis of these data. Unlike the prior art, therefore, it is possible to dispense with the complicated and troublesome task of operating the switches to reset each item of data whenever an article to be wrapped is changed.

As many apparently widely different embodiments of the present invention can be made without departing from the spirit and scope thereof, it is to be understood that the invention is not limited to the specific embodiments thereof except as defined in the appended claims.

What we claim is:

1. A film folding control apparatus of a wrapping system having a wrapping machine in which a length of film fed by a film feeding mechanism is extended at a predetermined section of the wrapping machine, an article to be wrapped is raised into engagement with the extended film from therebelow, and the edges of the film are folded under the bottom of the article, thereby wrapping the article in the film, by a film folding mechanism comprising left, right and front folding plates, said control apparatus comprising:

data setting means for setting film length data, film tension data and tray type data in dependence upon the article to be wrapped;

memory means for storing predetermined film length data, film tension data and tray type data in correspondence with an article number of the article to be wrapped; and a control unit responsive to an input of the article number of the article to be wrapped for reading the corresponding film length data, film tension data and tray type data out of said memory means and for controlling, on the basis of the read data, an operation timing of each operating section of the wrapping machine.

2. The control apparatus according to claim 1, wherein combinations of the film length data, film tension data and tray type data and corresponding parameters are stored in correspondence with article numbers in said memory means, and said data are set based on said parameters.

3. The control apparatus according to claims 1 or 2, further comprising data modifying means for temporarily modifying data in a state where each of item of said data has been called by inputting to the control unit the article number of the article to be wrapped.

4. The control apparatus according to claim 1 or 2, further comprising changeover means for selecting data set by said data setting means or data from said memory means.

5. The control apparatus according to claims 1 or 2, further comprising a temperature sensor for sensing film temperature, and wherein correction values for correcting the operation timing of each operating section with respect to temperature are stored in said memory means, the operation timing of each operating section being corrected in dependence upon temperature.

6. A film folding control apparatus of a wrapping system having a wrapping machine in which a length of film fed by a film feeding mechanism is extended at a predetermined section of the wrapping machine, an article to be wrapped is raised into engagement with the extended film from therebelow, and the edges of the film are folded under the bottom of the article, thereby wrapping the article in the film, by a film folding mechanism comprising left, right and front folding plates, and a weighing and pricing machine for weighing and pricing an article to be wrapped said control apparatus comprising:

data setting means provided on said wrapping machine for setting film length data, film tension data and tray type data in dependence upon the article to be wrapped;

memory means provided on said weighing and pricing machine for storing predetermined film length data, film data and tray type data in correspondence with an article number of the article to be wrapped; and a control unit responsive to an input of the article number of the article to be wrapped for reading the corresponding film length data, film tension data and tray type data out of said memory means and for controlling, on the basis of the read data, an operation timing of each operating section of the wrapping machine.

7. The control apparatus according to claim 6, wherein parameters designating the film length data, film tension data and tray type data and corresponding parameters are stored in correspondence with article numbers in said memory means, and said data are set based on said parameters.

8. The control apparatus according to claims 6 or 7, further comprising data modification means for temporarily modifying data in a state where each item of said data has been called by inputting to the control unit the article number of the article to be wrapped.

9. The control apparatus according to claims 6 or 7, further comprising changeover means for selecting data set by said data setting means or data from said memory means.

10. The control apparatus according to claim 9, wherein said data modifying means and said changeover means are provided on an operator's section of said weighing and pricing machine.

11. The control apparatus according to claims 6 or 7, further comprising a temperature sensor for sensing film temperature, and wherein correction values for correcting the operation timing of each operating section with respect to temperature are stored in said memory means, the operation timing of each operating section being corrected in dependence upon temperature.

12. A weighing, wrapping and pricing system comprising:

a stretchable film wrapping machine including:

an infeed conveyance unit having infeed conveyance means for feeding an article to be wrapped into the wrapping machine;

elevator means for raising the article to be wrapped, which has been fed in by said infeed conveyance unit, up to a wrapping position;

film feeding means for feeding a stretchable film, which has been cut to a predetermined length, to a predetermined position crossing and upward stroke of said elevator means;

folding means for folding edge portions of the stretchable film, which is engaging an upper surface of the article to be wrapped due to said article having been raised by said elevator means, under a bottom portion of said article;

an outfeed conveyance unit having outfeed conveyance means for feeding the article out of the wrapping machine after the article has been wrapped;

input means for inputting film length data, film tension data and tray type data;

timing deciding means for deciding, based on the data input by said input means, operation timings of respective folding control operating sections; and wrapping control means for actuating each of the operating sections at the respective operation timing decided by said timing deciding means;

a weighing and pricing machine including:

weighing means incorporated in said infeed conveyance unit of said stretchable film wrapping machine;

label printing and affixing means arranged in said outfeed conveyance unit;

weighing and pricing control means for calculating a price of the article to be weighed based on weight data, indicative of the weight of the article, from said weighing means, and given unit price data indicative of the unit price of said article, printing data inclusive of the calculated price on a label, and automatically affixing the printed label to said article;

a console unit having input means for inputting data to said weighing and pricing control means, and display means for displaying said data; and memory means in which are previously stored, in correspondence with articles to be wrapped, data indicative of unit price and article name for said weighing and pricing control means, as well as wrapping machine control data for specifying the film length data, film tension data and tray type data; and communication means for enabling an exchange of data between the wrapping control means of said stretchable film wrapping machine and the weighing and pricing control means of said weighing and pricing machine;

wherein data specifying an article to be wrapped are entered from the input means of the console unit of said wrapping machine, whereby preset data indicative of unit price and article name and the wrapping machine control data are read out of said memory means in correspondence with the article to be wrapped, the wrapping machine control data read are transmitted to the wrapping control means of the stretchable film wrapping machine by said communication means, and the operation timing of each operating section of the stretchable film wrapping machine is decided based on said transmitted data.

13. The system according to claim 12, wherein the wrapping machine control data preset and stored in said memory means are wrapping parameters corresponding to combinations of film length data, film tension data and tray type data, said stretchable film wrapping machine has memory means in which is set and stored a correspondence table indicating correspondence between said wrapping parameters and said film length, film tension and tray type data, a wrapping parameter transmitted to the wrapping control means by said communication means is converted into film length data, film tension data and tray type data by said table, and said timing deciding means decides the operation timing of each operating section based on each item of data after conversion.

14. The system according to claim 12, wherein data read out of said memory means by inputting data specifying an article to be wrapped from the input means of the console unit of said weighing and pricing machine are displayed on display means of the console unit.

15. The system according to claim 14, further comprising data modifying means for temporarily modifying, through use of the input means of said console unit, data read out of said memory means and displayed by said display means.

16. The system according to claims 12 or 13, further comprising changeover means for rendering effective data inputted by the input means of said wrapping machine in place of the wrapping machine control data read out of said memory means.

17. The system according to claim 16, wherein a changeover performed by said changeover means is carried out by using the input means of said console unit.

18. The system according to claim 17, wherein said console unit is constructed separately of said label printing and affixing means, and a face of said console unit on which the input means and display means are disposed is arranged on a front side of an upper face of said wrapping machine so as to be close to the input means of said wrapping machine and oriented in substantially the same direction.

19. The system according to claim 16, wherein the stretchable film folding machine further includes a temperature sensor for sensing the temperature of the stretchable film before the film is used for wrapping, and wherein said timing deciding means determines the operation timing of each folding control operating section based on film length data, film tension data and tray type data input by the input means of said wrapping machine, or film length data, film tension data and tray type data specified by data transmitted by said weighing and pricing machine, and an output from said temperature sensor.

* * * * *